US009022680B1

(12) United States Patent
Lubyanitskiy et al.

(10) Patent No.: US 9,022,680 B1
(45) Date of Patent: May 5, 2015

(54) REFILLABLE TOOTHBRUSH AND TOOTHPASTE CARTRIDGE

(71) Applicant: Daniel Lubinitsky, Forest Hills, NY (US)

(72) Inventors: Grigoriy Davidovich Lubyanitskiy, Jackson Heights, NY (US); Daniel Lubinitsky, Forest Hills, NY (US)

(73) Assignee: Daniel Lubinitsky, Forest Hills, NY (US)

( * ) Notice: Subject to any disclaimer, the term of this patent is extended or adjusted under 35 U.S.C. 154(b) by 0 days.

(21) Appl. No.: 14/338,605

(22) Filed: Jul. 23, 2014

(51) Int. Cl.
*A46B 11/02* (2006.01)
*A46B 11/00* (2006.01)

(52) U.S. Cl.
CPC ..... *A46B 11/0055* (2013.01); *A46B 11/0072* (2013.01); *A46B 11/0062* (2013.01); *A46B 11/0041* (2013.01)

(58) Field of Classification Search
USPC ..... 401/187, 188 R, 141, 142
See application file for complete search history.

(56) References Cited

U.S. PATENT DOCUMENTS 3,256,894 A * 6/1966 Sherman ..... 401/176
5,462,377 A * 10/1995 Martinez et al. ..... 401/185

* cited by examiner

*Primary Examiner* — David Walczak
*Assistant Examiner* — Joshua Wiljanen

(57) ABSTRACT

Disclosed herein is a refillable toothbrush with a refillable toothpaste chamber also adapted to contain a toothpaste cartridge. Thus the toothpaste chamber can be filled directly by toothpaste from different types of toothpaste tubes, or the consumer can use a toothpaste cartridge. An essential distinctive feature of the present invention is realization of two functions by means of the protective cap: its direct function—protecting the bristles in stowed position, and an additional function, namely—feeding toothpaste to the bristle section. The toothbrush is made of a small number of simple parts, is easy to manufacture, has the opportunity to be simply assembled-disassembled, and is easily cleaned. To facilitate cleaning of the toothbrush head conduit from the remnants of toothpaste before the next recharge of the toothbrush, it can be complete with a special removable rod having an ability to be let-in the conduit. A distinctive feature of the removable rod is that it fulfills additional useful functions: prevents paste hardening in conduit at long non-use of a brush; can serve as a toothpick; can serve as means for piercing membrane of a cartridge. The toothbrush can also be complete with a special clip for fixing it in the user's pocket. A special design of the clip provides it with an additional function that allows for the user to dose out more precisely supplied toothpaste to the bristles. A new kind of cartridge is also disclosed herein.

19 Claims, 15 Drawing Sheets

REFILLABLE TOOTHBRUSH AND TOOTHPASTE CARTRIDGE

BACKGROUND OF THE INVENTION

1. Field of the Invention

Normally people brush their teeth at home, storing their toothbrush and a tube of toothpaste in the bathroom. However, when people travel, proper care of the teeth becomes problematic. Another problem arises if it is necessary to brush ones teeth after a meal if one is away from home (on a visit, at restaurant, etc.). Special necessity arises for frequent brushing of teeth in the case of people with dentures.

Many designs of toothbrushes with self-dispensing toothpaste chambers have been suggested to combine the toothbrush and toothpaste container into one object. However, such products are not widely marketed or represented.

The present invention relates generally to toothbrushes with paste dispensing and in particular to travel and portable toothbrushes in which is provided the toothpaste dispensing to the toothbrush bristles and is provided an easy loading of toothbrushes with toothpaste.

2. Description of the Prior Art

Numerous patents have been provided in prior art. For example, U.S. Pat. Nos. 4,128,349; 4,265,560; 4,583,563; 4,844,641; 4,919,156; 5,439,014; 5,462,377; 6,056,466; 7,021,851 and 7,244,073 all are illustrative of such prior art.

In U.S. Pat. No. 4,128,349 issued in the name of Del Bon, a toothbrush which carries its own charge of toothpaste is disclosed. While an invention made in accordance with this disclosure allows for the consumer to utilize their preferred brand of toothpaste, it comprises many individual pieces and is not suitable for a cost-effective product produced by mass production methods. The multitude of pieces along with the tight tolerances involved do not allow for ease of cleaning nor continuous operation without clogging.

In U.S. Pat. No. 4,265,560 issued in the name of Spica, is disclosed a disposable toothbrush with a self-contained toothpaste supply comprising a transparent handle section and an adjustable brush head having upstanding bristles secured thereto. The transparent cylindrical handle section is hollow and contains the dentifrice material, which is discharged into the adjustable head section when the handle section is compressed. The quantity of discharge of the dentifrice material can be easily measured and judged by the graduation marks placed on the handle. The adjustable brush head has a discharge opening for ejecting the dentifrice material between the bristles when the cylindrical transparent handle section is compressed. The adjustable brush head is capable of being closed so that premature or accidental discharge of the dentifrice material while either in storage or in use does not occur. While an invention made in accordance with this disclosure allows for more than one use, the number of uses is fairly limited and the consumer is forced to use the type of toothpaste that is packaged with the toothbrush and not necessarily the type of toothpaste the customer usually uses.

In U.S. Pat. No. 4,583,563 issued in the name of Turner, is disclosed a combined toothbrush and toothpaste dispenser, and a disposable toothpaste cartridge for use therein, comprising a brush having a hollow neck and a base with a non-circular opening adapted to receive a complementary non-circular mouth on a disposable toothpaste cartridge. A split tubular element is adapted to be assembled to the brush base and is rotatable with respect thereto. Ribs on the tubular element are disposed so as to clamp the mouth-remote end of the toothpaste cartridge so that rotation of the tubular element with respect to the brush base squeezes toothpaste from the cartridge and through the brush neck to the brush head. A tapering shoulder on the toothpaste cartridge adjacent to the mouth cooperates with a ledge on the split tubular element for preventing sliding removal of the mouth from the brush base opening during use. In one embodiment of the invention, the split tubular element forms the handle of the combined toothbrush and toothpaste dispenser, while in another embodiment the handle is integral with the brush and the split tubular element is slidably telescopically received within said handle.

In U.S. Pat. No. 4,844,641 issued in the name of Grosfilley et al., disposable toothbrush is disclosed. While such disclosure possesses an internal charge of toothpaste, it is one-time charge only and is designed to be disposed of after a single use. While such invention may prove useful for emergencies or during short travel periods, it is not cost effective for daily use or during periods of extended travel, as the space required to carry the necessary number of disposable toothbrushes would be great.

In U.S. Pat. No. 4,919,156 issued in the name of Gipson, a combination dental device is disclosed. This device having mounted therein a toothbrush at one end covered by a removable cap having a pocket clip thereon, while containing a refillable toothpaste cartridge, does not resemble a conventional toothbrush. This fact may lead to resistance to purchase such a device on the pail of the consumer.

In U.S. Pat. No. 5,439,014 issued in the name of Moussa, an apparatus for dispensing of toothpaste internally through the handle of a toothbrush is disclosed. A problem associated with an apparatus made in accordance with this disclosure is that the user has no control over the flow of the toothpaste and must rely on the force of gravity to pull the toothpaste from within the handle.

In U.S. Pat. No. 5,462,377 issued in the name of Martinez, Jr. et al., a toothbrush with integral pump bellows pre-filled with toothpaste is disclosed. This invention suffers from the fact that the consumer is limited to the toothpaste that is supplied with the toothbrush. Clearly this is not acceptable to those users who use more than the average amount of toothpaste and are forced to dispose of the toothbrush while it is still in satisfactory shape. Adversely, those users who wear out the toothbrush before the toothpaste is depleted suffer monetary losses as the remaining toothpaste is wasted.

In U.S. Pat. No. 6,056,466 issued in the name of Johnson, et al., a toothbrush with a refillable toothpaste chamber which provides for the storage of toothpaste of choice within the handle section is disclosed. The toothpaste tube mates with a matching threaded connection on the lower surface of the handle to allow filling of the present invention with no or minimal wasted toothpaste. When the conventional toothpaste tube is removed, a pressurizing pump is installed to allow the user to pressurize the toothpaste chamber. To dispense the toothpaste product, the user simply activates a valve to allow the flow of toothpaste up the handle of the toothbrush where it exits from within the brush assembly of the toothbrush. The toothpaste chamber holds a sufficient amount of toothpaste to allow for several tooth brushing cycles or for a period of use during short travel times. When the internal supply is depleted, the invention is refilled by repeating the above process.

Along with certain advantages of this invention, certain disadvantages are inherent in it. For example, to store the toothbrush requires a special case. Another drawback is the complexity of the toothbrush manufacture, as it consists of set non-standard devices such as a pneumatic pump and a valve, the existence of which also reduces the reliability of operation of the toothbrush, moreover complicated by rinsing the toothbrush, when necessary. Another disadvantage of an invention made in accordance with this disclosure does not allows for the consumer to utilize their preferred brand of toothpaste, because a thread the toothbrush and a toothpaste tube may not coincide.

In U.S. Pat. No. 7,021,851 issued in the name of King, a toothbrush incorporating dentifrice dispenser is disclosed. Said toothbrush having a conduit leading through the brush body to a plurality of egress apertures positioned within the bristle base of the brush covered by a slide tab having corresponding apertures that can be moved between an aligned open and an offset closed position to keep the dentifrice from drying out between usage's.

Along with certain advantages of this invention, certain disadvantages are inherent in it. The disadvantages of this invention include the presence of a non-standard injector pump, slide mechanism, which complicate manufacturing the toothbrush, increase its cost price and reduce the reliability of its operation. Furthermore, said toothbrush can be used only with the special toothpaste cartridges.

In U.S. Pat. No. 7,244,073 issued in the name of Trocino, a travel toothbrush assembly is disclosed. A toothbrush assembly has two main sections, a toothbrush head that incorporates toothbrush bristles and toothpaste holder. The toothbrush head has a bristle end and a shaft with an enclosed channel connecting the bristle end to a threaded end. A flexible tube extends from an opening in the channel to near the top of bristles. The threaded end mates to the chamber. The chamber is coupled to a plunger assembly having a plunger head that seals against the sides of the chamber. A toothpaste tube is threaded into the threaded end of the chamber and toothpaste is extracted from the toothpaste tube into the chamber or delivered from the chamber to the bristles. A universal adapter is used for non-compatible toothpaste tubes. The outside surface of the chamber has features that retain the cap that fits over the toothbrush head section and prevents leakage of any water or toothpaste remaining in the bristles after use.

Along with certain advantages of this invention, certain disadvantages are inherent in it. The main disadvantage of this invention include the provision of a complex mechanism for delivering toothpaste from the chamber to the bristles, which complicates the manufacturing of the toothbrush, increases its cost price, and reduces the reliability of its operation.

Another disadvantage is the need to use a special adapter for a non-compatible toothpaste tube. This attachment is separate and can be easily lost while traveling.

A review of the prior art indicates that there are many patents which relate to the use of a refillable toothbrush, but to the best of our knowledge, none of these have had any commercial success or acceptability by the retail consumers or the business community. While these devices may be suitable for the particular purpose to which they address, they would not be as suitable for the purposes of the present invention.

In these respects, the toothbrush according to the present invention substantially departs from the conventional concepts and designs of the prior art.

SUMMARY OF THE PRESENT INVENTION

A primary object of the present invention is to provide a universal, autonomic, portable, travel and refillable toothbrush, rechargeable by toothpaste and/or a toothpaste cartridge.

Another object of the present invention is to provide a toothbrush having a simple to manufacture and maintain means for supplying toothpaste to the toothbrush bristles.

Yet another object of the present invention is to provide suitable for a cost-effective product produced by mass production methods.

Still yet another object of the present invention is to provide a simple and user-friendliness filling a toothbrush, regardless of the type of toothpaste tube.

Another object of the present invention is to provide a toothbrush having the opportunity to simple assembly-disassembly and cleaning of its parts.

Yet another object of the present invention is to provide a toothbrush for nonexpendable use.

Yet another object of the present invention is to provide a toothbrush with easily-replaceable parts.

Yet another object of the present invention is to provide a toothbrush with a simple and non-conventional means for feeding toothpaste to toothbrush bristles.

Yet another object of the present invention is to provide a toothbrush cartridge.

The general purpose of the present invention, which will be described subsequently in greater detail, is to provide a new toothbrush with paste batcher apparatus which has many of the advantages of the toothbrushes mentioned heretofore and many novel features that result in a new toothbrush with paste batcher which is not anticipated, rendered obvious, suggested, or even implied by any of the prior art toothbrushes, either alone or in any combination thereof.

The present invention overcomes the shortcomings of the prior art by providing a portable toothbrush incorporating means for supplying and dispensing a toothpaste to the toothbrush bristles, at that the original means for supplying toothpaste combines the functions of a protective cap and a pump; an original toothbrush head and an original chamber for storing a toothpaste or a toothpaste cartridge allows to create a universal toothbrush, using both as directly toothpaste and a toothpaste cartridge. The design of invented toothbrush allows booting toothpaste regardless of toothpaste tube.

Various embodiments of the invention are also representing the original devices allowing effectively solving tasks in view.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

FIG. 1A is an illustrative perspective view of the present invention wherein a coupling of a toothbrush holder and a toothbrush head is made as a permanent joint while if a closing plug is made removable.

FIG. 1B is an illustrative perspective view of the present invention wherein a coupling of said holder and said toothbrush head is made as a detachable joint, while if said closing plug is made non-removable and can also be made removable.

FIG. 1C is a schematic sectional view of the present invention with removed protective cap.

FIG. 1D is a schematic sectional view of the present invention wherein the refillable toothbrush shown in on-position.

In FIG. 7A the removable protective cap of the refillable toothbrush further is provided with at least one sealing ring inserted into a ring groove on its inner surface.

In FIG. 7B the toothbrush holder's second part adjacent to its second distal end is provided with at least one sealing ring inserted into a ring groove on its outer surface, and/or wherein said holder's first part adjacent to its first end, is provided with at least one sealing ring inserted into a ring groove on its outer surface, and/or wherein said the second part of the toothbrush head adjacent to its second end is provided with at least one sealing ring inserted into a ring groove on its outer surface.

In FIG. 10B schematically shown the conduit's removable top end-cap which can consist of a closing head and a projection, located on one side of said closing head, adapted to be inserted into said conduit and having a socket for placing into it an end of a removable rod adapted to be let-in said conduit.

In FIG. 10C schematically shown the fragment of the toothbrush with a removable top end-cap provided with a removable rod shown in the FIG. 10B, inserted into the toothbrush's conduit.

In FIG. 10D schematically shown a removable rod additionally provided with bristles.

In FIG. 10E schematically shown a removable top end-cap further is provided with an additional socket located on the other side of said closing head for placing a removable rod.

FIG. 11A is schematic illustrative perspective view of the present invention in unassembled state. In FIG. 11A the dotted arrow indicates the direction of movement of a removable clip, having a spring clamp, with its mounting in the spring seat.

FIG. 11B is a schematic sectional view of fragment of the present invention, shown in FIG. 11A, in on-position.

FIG. 12A is a schematic sectional view of the present invention wherein the refillable toothbrush shown in on-position.

FIG. 12B is a schematic sectional view of the present invention wherein the refillable toothbrush shown in stowed position.

FIG. 13A is a schematic sectional view of the present invention wherein the refillable toothbrush shown in on-position.

FIG. 13B is a schematic sectional view of the present invention wherein the refillable toothbrush shown in stowed position.

In FIG. 13C is shown a fragment of the second distal end of the holder and the closing plug with put on them a removable back cover.

In FIG. 13D is shown a fragment of the second distal end of the holder and the closing plug with on it another kind of a removable back cover on it.

In FIG. 13E is shown a removable bottom end-cap inserted into reach-through hole in removable closing plug.

In FIG. 13F is shown a fragment of the second distal end of the holder and the closing plug with a removable bottom end-cap inserted into its reach-through hole.

In FIGS. the straight solid arrows indicate the direction of movement of a removable protective cap while extruding toothpaste. In the case of the removable protective caps with reach-through holes in the operating position, the holes are closed by the user.

DETAILED DESCRIPTION OF THE INVENTION

FIGS. 1A-1D are schematic views of the present invention. The present invention is a refillable toothbrush.

Figure 1A:
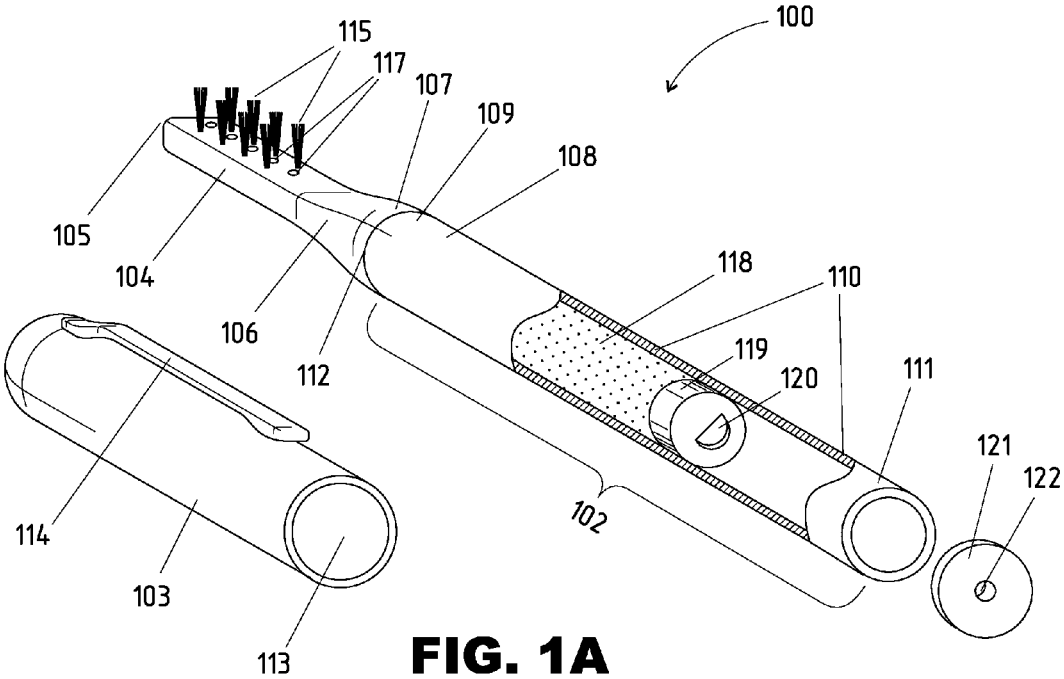
FIGS. 1A-1D are schematic views of the present invention. The present invention is a refillable toothbrush. An essential distinctive feature of the present invention is realization of two functions by means of the protective cap: its direct function—protecting the bristles in stowed position, and an additional function, namely—feeding toothpaste to the bristle section.

FIG. 1A is an illustrative perspective view of the present invention wherein a coupling of a toothbrush holder and a toothbrush head is made as a permanent joint while if a closing plug is made removable.

Figure 1B:
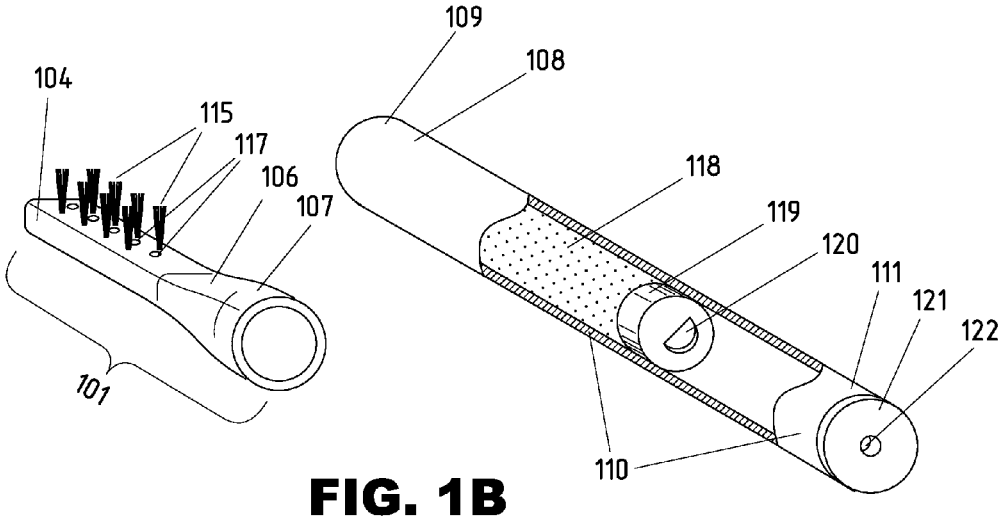

FIG. 1B is an illustrative perspective view of the present invention wherein a coupling of said holder and said toothbrush head is made as a detachable joint, while if said closing plug is made non-removable and can also be made removable.

Figure 1C:
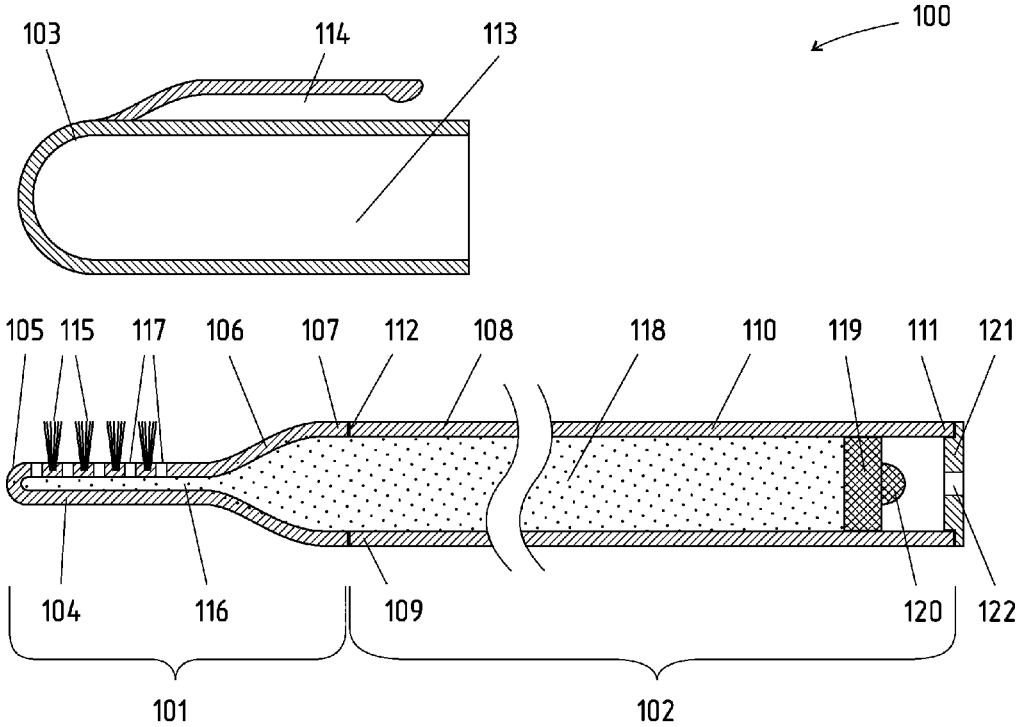

FIG. 1C is a schematic sectional view of the present invention with removed protective cap.

Figure 1D:
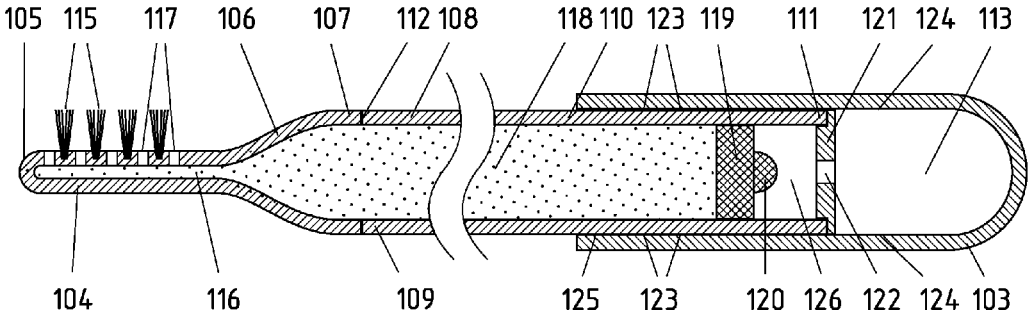

FIG. 1D is a schematic sectional view of the present invention wherein the refillable toothbrush shown in on-position.

A refillable toothbrush 100 comprising:

a toothbrush head 101, a holder 102 and a removable protective cap 103;

the toothbrush head 101 has a first part 104 adjacent to its first free end 105, and a second part 106 adjacent to its second end 107;

the holder 102 has a first part 108 adjacent to its first end 109, coupled to the second end 107 of said toothbrush head 101, and a second part 110 adjacent to its second distal end 111;

numeral 112 denotes a coupling of said holder 102 and said toothbrush head 101;

the removable protective cap 103 has a cavity 113 for placing and protecting said toothbrush head 101 and can have a clip 114;

the toothbrush head 101 has a bristle section 115, a conduit 116, disposed within said toothbrush head 101, and at least one toothpaste dispensing aperture 117 disposed on said bristle section 115 and being in communication with said conduit;

the holder 102 has a toothpaste chamber 118 disposed within its body, said toothpaste chamber 118 being in communication with said conduit 116, and into the toothpaste chamber is placed a plunger 119, which can have a tang 120, the pulling of which helps to facilitate removal of the plunger 119, wherein the second distal end 110 of said holder 102 is provided with a closing plug 121 having at least one reach-through hole 122 through which said toothpaste chamber is communicated with the atmosphere;

the removable protective cap 103 and the holder's second part 110, adjacent to its second distal end 111, are configured to form a kinematic pair having a sliding fit 123 (FIG. 1D) with respect to each other for the purpose of providing a sliding seal between the protective cap 103 and second part 110 of said holder 102.

Here numeral 124 denotes an inner surface of the protective cap 103 and numeral 125 denotes an outer surface of said second part 110 of said holder 102. A set of points on FIGS. designates toothpaste.

A coupling 112 of said holder 102 and said toothbrush head 101 is made as a permanent joint, for example, can be formed integrally, while if said closing plug is made removable (FIG. 1A), or a coupling of said holder and said toothbrush head is made as a detachable joint, while if said closing plug is made non-removable (FIG. 1B) or is made removable.

Detachable joints are generally applied to the couplings, which allow disassembly and reassembly of the parts without destruction and/or damage. These include, for example, threaded connections, bayonet connections, connections with gaskets, etc. (not shown).

The toothbrush can have a means for fixating a removable protective cap on the holder or on the toothbrush head, for example, a lock pin (not shown).

On the bristle section of the toothbrush the bristles may be located on one side, on two or more sides, and if the bristle section has a curved surface, the bristles may be located transversely to said curved surface (not shown).

Individual components of the toothbrush can be made of metal, nonmetal, and composite materials. Individual components of the toothbrush can also be transparent and opaque, and can also be made in different colors.

This embodiment of the present invention is to provide simplicity and user friendliness to the process of filling a toothbrush with toothpaste, regardless of the type of toothpaste tube. If the coupling 112 of said holder 102 and said toothbrush head 101 is made as a detachable joint, the toothpaste chamber 118 can be filled by toothpaste from side of the first end 109 of the holder 102. In this case initially the plunger 109 must be inserted into the toothpaste chamber 101.

In the instance that the closing plug 121 is made removable, the toothpaste chamber 118 can be filled by toothpaste from side of the second end 111 of the holder 102 and after that the plunger 109 must be inserted into the toothpaste chamber and the closing plug 121 must be coupled to the holder 102.

An essential distinctive feature of the present invention is accomplishment by the protective cap 103 two functions: its direct function—protecting the bristles in stowed position, and additional function, namely—forced feeding toothpaste in the bristle section 115. For this purpose the user sets the removable protective cap 103 in on-position (FIG. 1D) and begins to move it in the direction of the toothbrush head 101.

Inasmuch as the removable protective cap 103 and the holder's second part 110, adjacent to its second distal end 111, are configured to form a kinematic pair having a sliding fit 123 with respect to each other for the purpose of providing a sliding seal between the protective cap 103 and second part 110 of said holder 102, under the influence of moving the removable protective cap 103 in the direction of the toothbrush head 101 in the cavity 113 occurs an excessive air pressure, and air through at least one reach-through hole 122 in the removable closing plug 121 runs into the part 126 of the chamber 118 between plunger 119 and closing plug 121 and moves plunger 119 in a direction of the toothbrush head 101.

Under the influence of the plunger 119 toothpaste is forcibly pressed out from the toothpaste chamber 118 through the conduit 116 such that a portion of the toothpaste is dispensed onto the bristle section 115. During toothbrushing the removable protective cap 103 may be located in on-position, as it extends the holder 102, which improves usability of the toothbrush. Thus the removable protective cap 103 carries out one more additional useful function. After brushing, the removable protective cap 103 is mounted in stowed position to perform its direct functions.

The present invention solves the problem of creating autonomic, portable, travel and refillable toothbrush, while, thanks to the original design means' for supplying paste to the bristles, simplifies the manufacturing process of such toothbrushes and reduced their costs. Furthermore such design of the invented toothbrush improves the conditions of its cleaning from the remnants of toothpaste before the next recharge.

Figure 2:
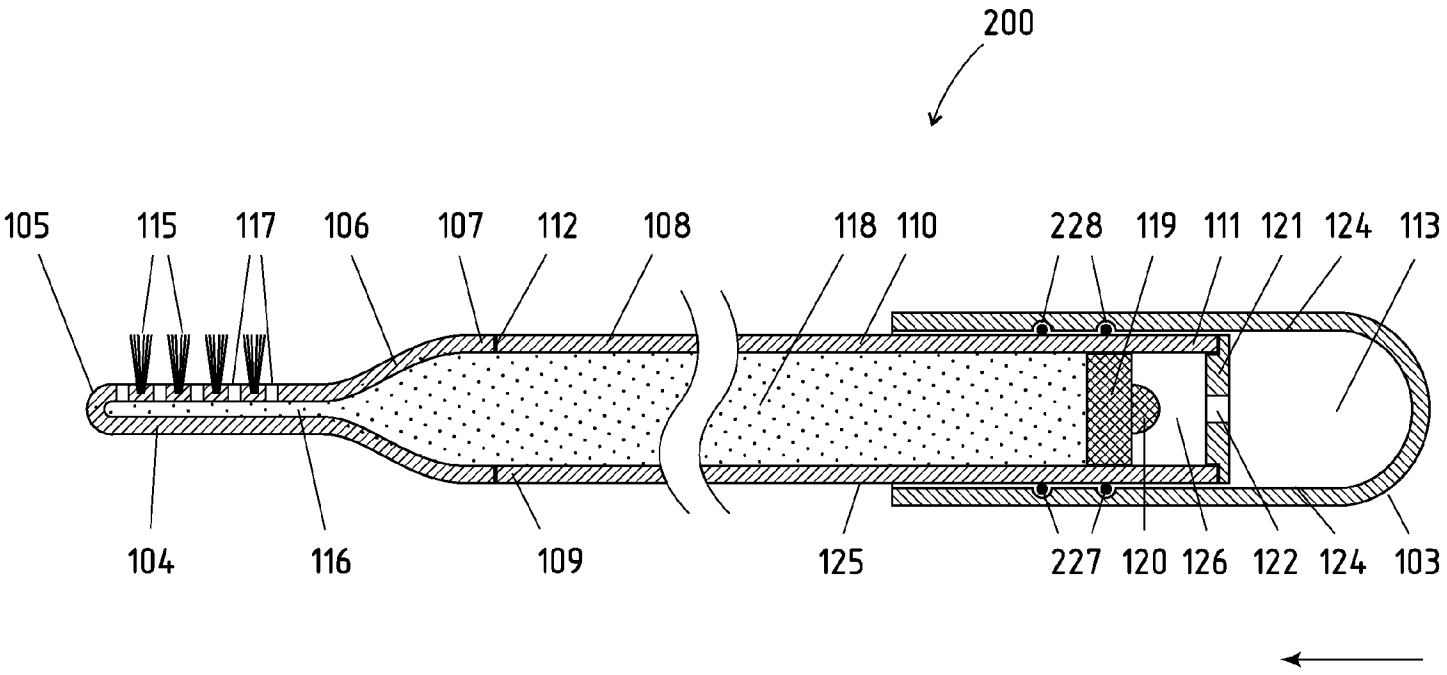
FIG. 2 is a schematic cross sectional view of another embodiment of the present invention in on-position wherein the removable protective cap further is provided with at least one sealing ring and between said sealing ring and the outer surface of the second part of the holder is formed a sliding seal.

FIG. 2 is a schematic cross sectional view of another embodiment 200 of the present invention in on-position. This embodiment of the present invention includes all features of the invention shown in FIGS. 1A-1D, but besides in this embodiment the removable protective cap 103 further is provided with at least one sealing ring 227 inserted into a ring groove 228 on its inner surface 124.

Figure 3:
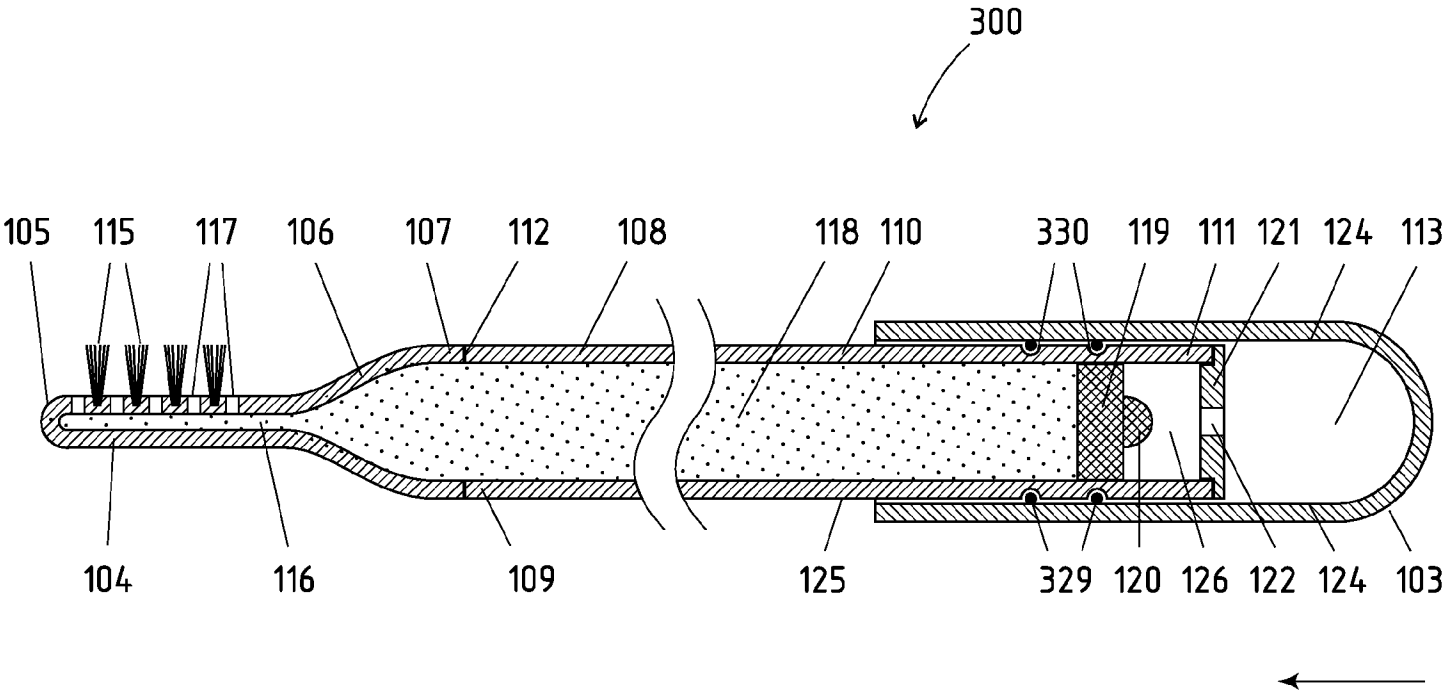
FIG. 3 is a schematic cross sectional view of yet another embodiment of the present invention in on-position wherein the second part of the holder further is provided with at least one sealing ring and between said sealing ring and inner surface of the removable protective cap is formed a sliding seal.

In FIG. 3 is shown a schematic cross sectional view of another embodiment 300 of the present invention in on-position. This embodiment of the present invention includes all features of the invention shown in FIGS. 1A-1D, but besides, in this embodiment the second distal end 111 of the holder 102 further is provided with at least one sealing ring 329 inserted into a ring groove 330 on its outer surface 125.

In these two embodiments (FIGS. 2 and 3) of the present invention the sliding seal is achieved by means of sealing rings.

In the embodiment, shown in FIG. 2, the sliding seal is formed between at least one sealing ring 227 and the outer surface 125 of the second part 110 of the holder 102.

In the embodiment, shown in FIG. 3, the sliding seal is formed between at least one sealing ring 329 and the inner surface 124 of the protective cap 103.

With such implementation of the refillable toothbrush, the manufacturing is simplified and the cost is reduced, because this reduces the requirements for precision manufacturing of the holder and the protective cap.

Figure 4:
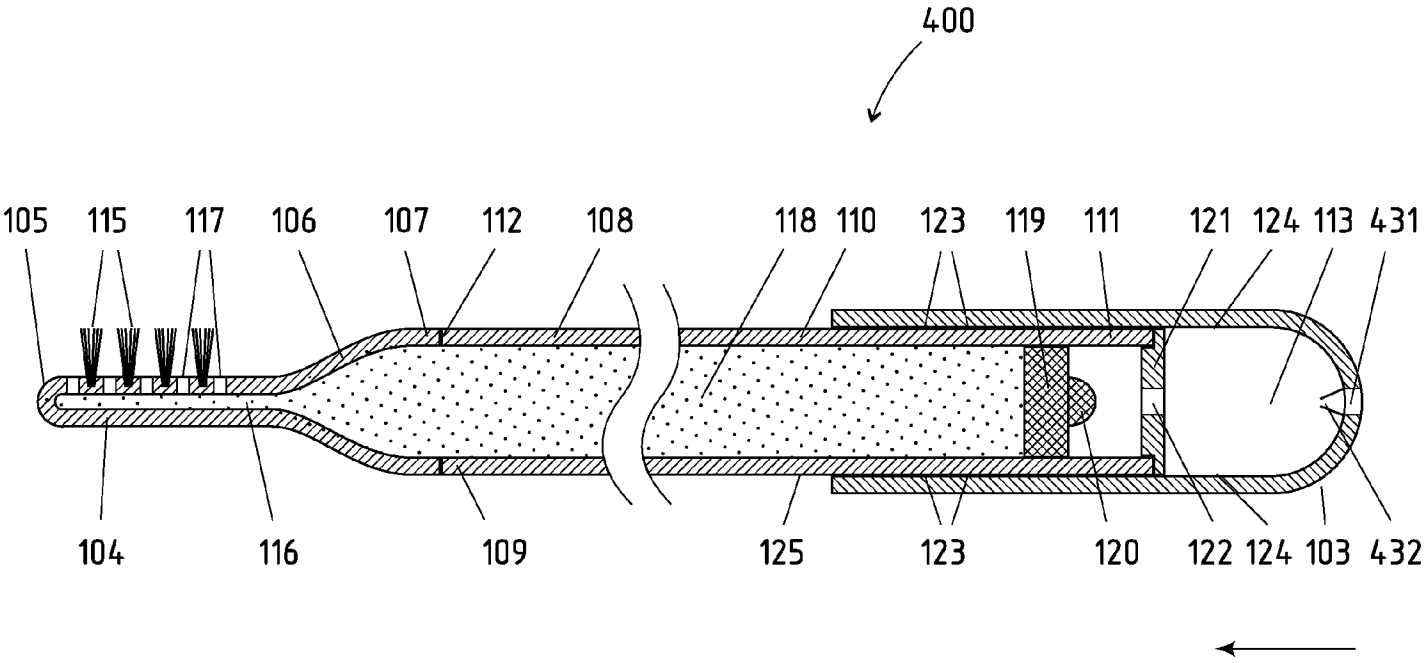
FIG. 4 is a schematic cross sectional view of one more embodiment of the present invention in on-position, wherein removable protective cap further is provided with a check valve.

In FIG. 4 is shown a schematic cross sectional view of another embodiment of the present invention in on-position. This embodiment of the present invention includes all features of the invention shown in FIGS. 1A-1D, but besides in this embodiment the removable protective cap 103 of the refillable toothbrush 400 further is provided with a check valve 432 overlapping a reach-through hole 431 in the protective cap 103. The cavity 113 of the protective cap 103 through the reach-through hole 431 is communicated with the atmosphere, when the check valve 432 is open. The check valve 432 opens when said removable protective cap 103 is displaced in direction from the center of said holder 102 to its second distal end 111 and closes when said removable protective cap 103 is displaced towards to the center.

When removable protective cap 103 is displaced from its second distal end 111 towards to the center the check valve 432 is closed and into the cavity 113 there is an excessive air pressure, and air through at least one reach-through hole 122 in the removable closing plug 121 runs into the part 126 of the chamber 118 between plunger 119 and closing plug 121 and moves plunger 119 in a direction toothbrush head 101. Squeezing toothpaste onto the bristle section 115, similar to that described above.

At moving the removable protective cap 103 in the opposite direction the check valve 432 is opened and the pressure into the cavity 113 becomes equal to the atmospheric pressure. Moving the removable protective cap 103 back and forth can more precisely dispense the required amount of toothpaste, squeezed onto the bristles.

This embodiment of the present invention not only allows more accurate dosing of toothpaste, but almost full use of the toothpaste chamber placed in 118 of its volume. After brushing, the removable protective cap 103 is mounted in stowed position to perform its direct functions.

Figure 5:
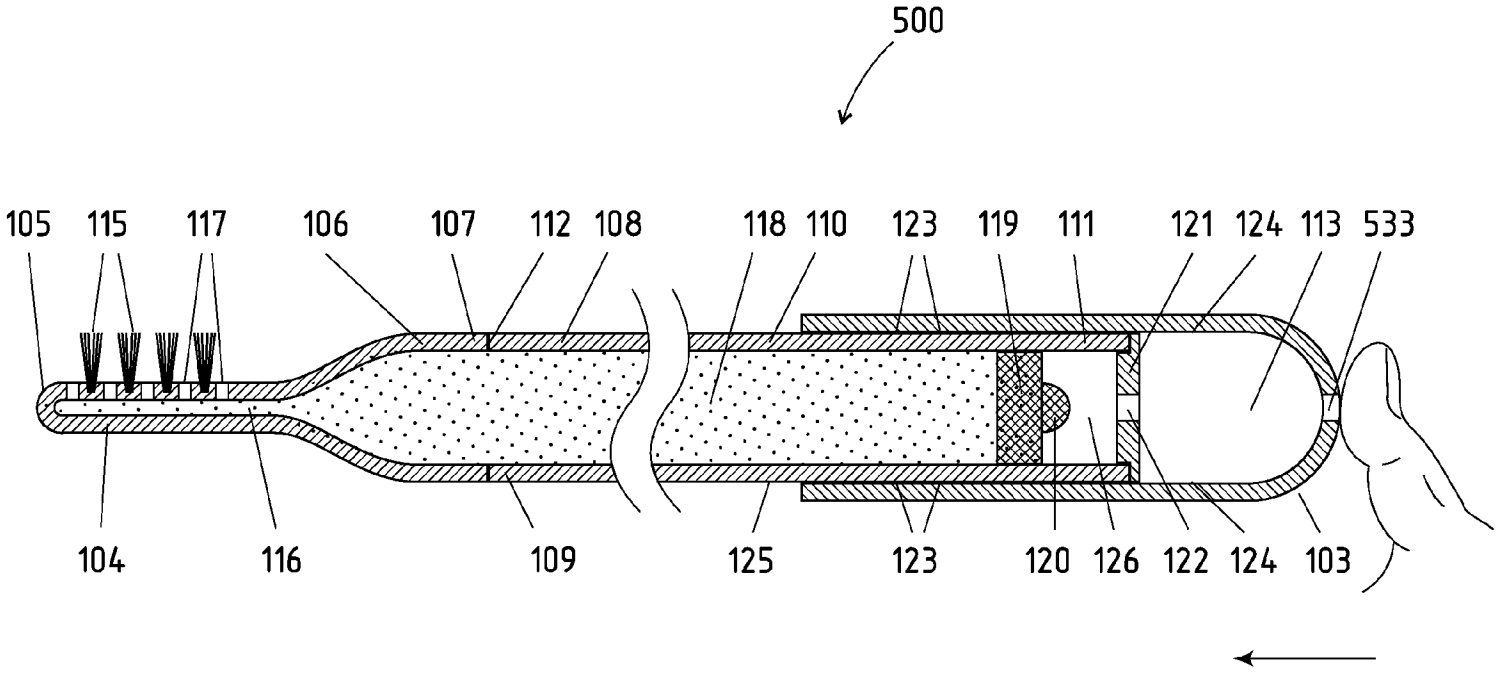
FIG. 5 is a schematic cross sectional view of yet another embodiment of the present invention in on-position, wherein removable protective cap further is provided with at least one reach-through hole by means of opening or closing said reach-through hole a user can regulate the flow of toothpaste on bristles.

In FIG. 5 is shown a schematic cross sectional view of yet another embodiment of the present invention in on-position. This embodiment of the present invention includes all features of the invention shown in FIGS. 1A-1D, but besides in this embodiment the removable protective cap 103 of the refillable toothbrush 500 further is provided with at least one reach-through hole 533 through which the cavity 113 of the protective cap 103 is communicated with the atmosphere and said reach-through hole or holes have a feature to be closed by a user.

In this embodiment of the present invention just as in other embodiments of the present invention the reach-through hole or holes can be located also on the side of the removable protective cap near its closed end (not shown).

This embodiment of the present invention allows the use of all the advantages of the previous embodiment of the invention, but it simplifies the construction of refillable toothbrush by eliminating the check valve 432, because a user executes the check valve function by blocking or unblocking the through-hole 533 with his/her finger.

Figure 6:
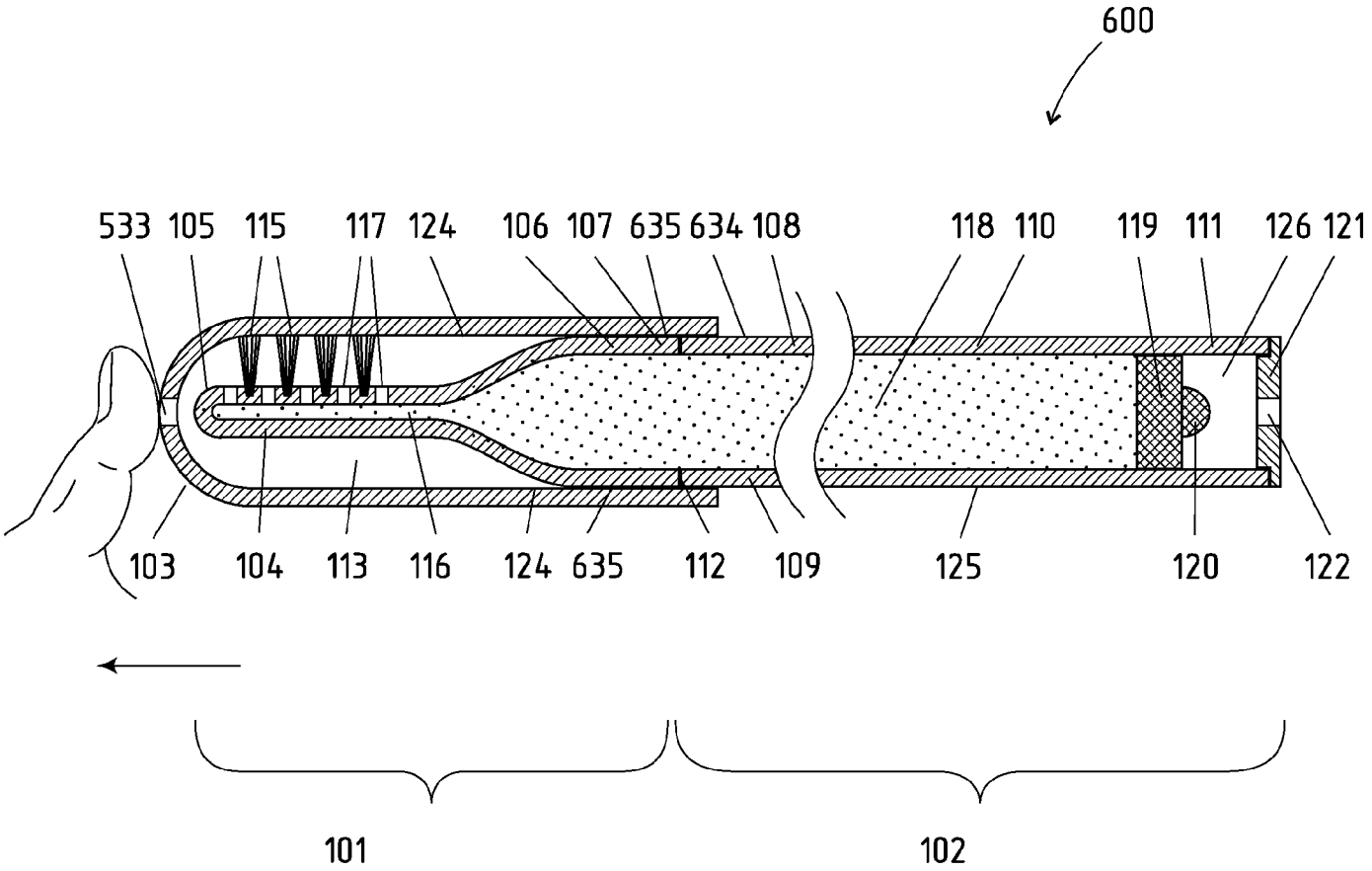
FIG. 6 is a schematic cross sectional view of modified embodiment of the present invention. This embodiment allows the use of all the advantages of the previous embodiment (FIG. 5) and additional allows dispensing toothpaste onto the bristle section directly in the stowed position.

In FIG. 6 is shown a schematic cross sectional view of yet another embodiment of the present invention, representing a modification of the previous embodiment (FIG. 5), wherein the removable protective cap 103 of refillable toothbrush 600 and the holder's first part 108, adjacent to the holder's first end 109, further are configured to form a kinematic pair having a sliding fit 634 with respect to each other for the purpose of providing a sliding seal between the protective cap 103 and first part 108 of said holder 102 and/or said removable protective cap 103 and the second part 106 of the toothbrush head 101, adjacent to its second end 107, further are configured to form a kinematic pair having a sliding fit 635 with respect to each other for the purpose of providing a sliding seal between the protective cap 103 and the second part 106 of the toothbrush head.

This embodiment of the present invention allows the use of all the advantages of the previous embodiment of the invention (FIG. 5) and additional allows dispensing toothpaste onto the bristle section 115 directly in the stowed position. This expands the technological capabilities of the toothbrush.

For this purpose, a user blocks the reach-through hole 533 in the removable protective cap 103 with a finger and moves the protective cap in a direction of from the center of the holder 102 to the first free end 105 of the toothbrush head 101 (the straight solid arrow shows the direction of motion).

Inasmuch as between the inner surface 124 of the removable protective cap 103 and outer surface of the holder's first part 108 and/or between the inner surface 124 of the removable protective cap 103 and outer surface of the second part 106 of the toothbrush head 101 is formed a sliding fit —accordingly 634 and/or 635, into the cavity 113, when the removable protective cap moving in this direction, forms a vacuum. Due to it the pressure into the part 126 of the chamber 118 exceeds the pressure in the cavity 113. The cavity 113 fluidly connected with the dispensing aperture 117 which is in turn connected via conduit 116 to a portion of the chamber 118 located in front of the plunger 119. Under the influence of vacuum on one side and the plunger pressure on the other side toothpaste, contained in chamber 118, is squeezed out of it and dispensed between the bristles of bristle section 115.

Taking off the removable protective cap 103 from the toothbrush head 101 and installation the protective cap in stowed position is made by the user at opened reach-through hole 533.

Figure 7A:
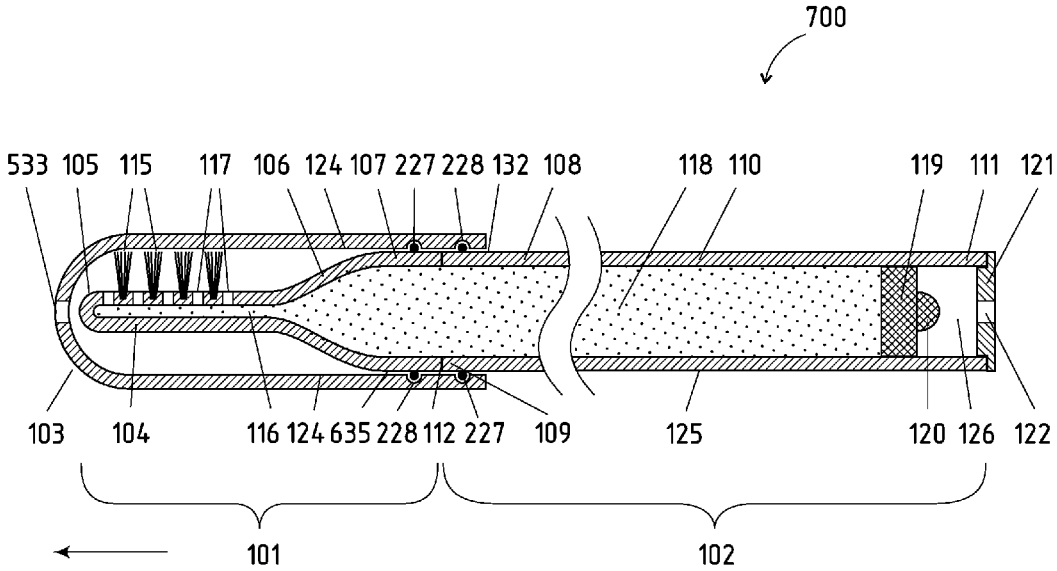
FIG. 7A and FIG. 7B are a schematic cross sectional views of yet other embodiments of the present invention, representing modifications of the previous embodiment (FIG. 6).

In FIG. 7A is shown a schematic cross sectional view of yet another embodiment of the present invention, representing a modification of the previous embodiment (FIG. 6), wherein the removable protective cap 103 of the refillable toothbrush 700 further is provided with at least one sealing ring 227 inserted into a ring groove 228 on its inner surface.

Figure 7B:
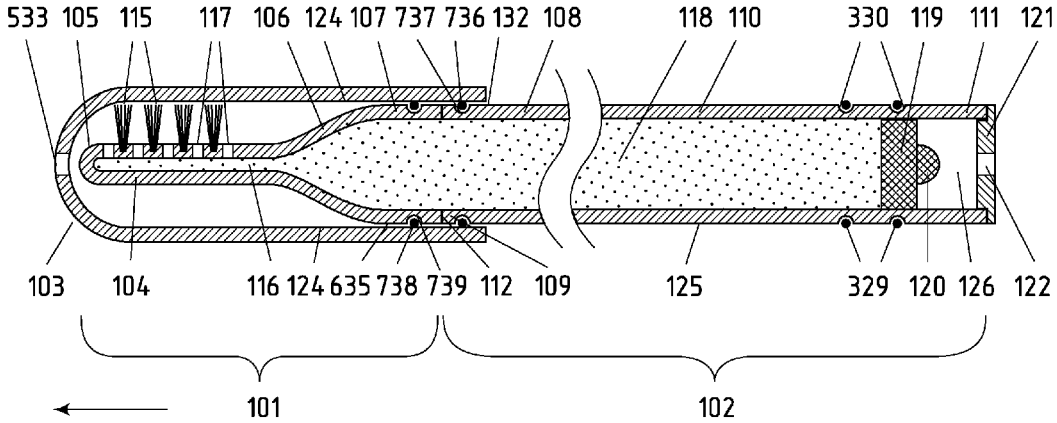

In FIG. 7B is shown a schematic cross sectional view of yet another embodiment of the present invention, representing another modification of the embodiment presented on FIG. 6, wherein accordingly the toothbrush holder's second part 110 adjacent to its second distal end 111 is provided with at least one sealing ring 329 inserted into a ring groove 330 on its outer surface, and/or wherein said holder's first part 108 adjacent to its first end 109, is provided with at least one sealing ring 736 inserted into a ring groove 737 on its outer surface, and/or wherein said the second part 106 of the toothbrush head 101 adjacent to its second end 107 is provided with at least one sealing ring 738 inserted into a ring groove 739 on its outer surface.

In these two embodiments (FIGS. 7A and 7B) of the present invention the sliding seal is achieved by means of sealing rings.

In the embodiment, shown in FIG. 7A, the sliding seal is formed between at least one sealing ring 227 in removable protective cap 103 and the outer surface of the second part 110 of the holder 102, and/or between said sealing ring 227 and the outer surface of the holder's first part 108 adjacent to its first end 109, and/or between said sealing ring 227 and the outer surface of the second part 106 of the toothbrush head 101 adjacent to its second end 107.

In the embodiment, shown in FIG. 7 B, the sliding seal is formed between the inner surface 124 of the protective cap 103 and/or accordingly at least one sealing ring 329, and/or at least one sealing ring 736, and/or at least one sealing ring 738.

Such implementation of the invented refillable toothbrush simplifies its manufacturing and reduces the cost, because this reduces the requirements for precision manufacturing the holder, toothbrush head and protective cap.

Figure 8:
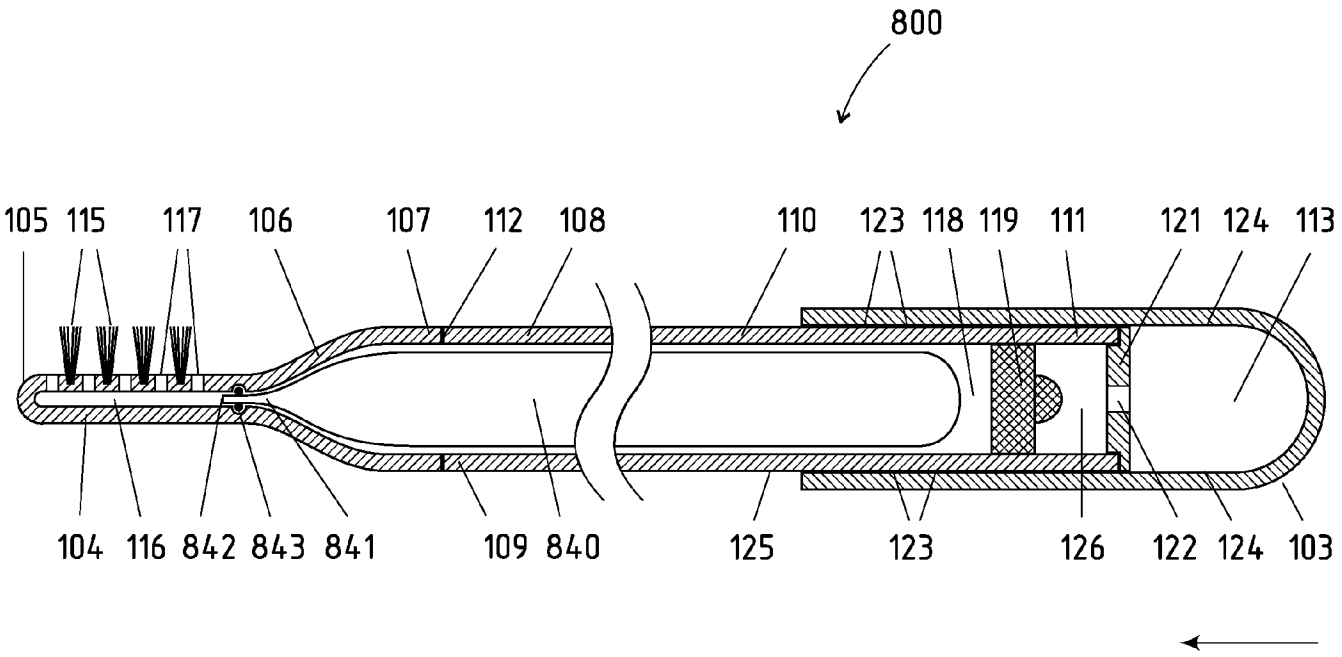
FIG. 8 is a schematic cross sectional view of another embodiment of the present invention, wherein toothpaste chamber further is adapted to contain a toothpaste cartridge.

In FIG. 8 is shown a schematic cross sectional view of another embodiment 800 of the present invention, which includes all features of the invention shown in FIGS. 1A-1D and wherein said toothpaste chamber 118 further is adapted to contain a toothpaste cartridge 840, having a neck 841 ending by outlet 842. Said toothpaste cartridge 840 under an external pressure is capable of supplying toothpaste through its outlet 842, and the toothpaste head 101 is adapted to be removably and hermetically connected to said cartridge, for example by means of elastomeric O-ring seal 843, so that the conduit 116 of said toothbrush head 101 would be in communication with said outlet 842 of said cartridge 840.

The purpose of the cartridge is to provide a removable container for storing toothpaste within the toothpaste chamber 118 and to enable the delivery of the toothpaste to the conduit 116 of the toothbrush head 101 and then to the toothpaste dispensing aperture or apertures 117.

If the closing plug 121 is made removable, the cartridge 840 can be installed into the toothpaste chamber 118 and then becomes attached to the toothpaste head 101 when the toothbrush head 101 is attached to the holder 102.

If the coupling 112 of the holder 102 and the toothbrush head 101 is made as a detachable joint, i.e. the toothbrush head 101 is made removable, the cartridge 840 can be attached to the toothpaste head 101 first and then both components are fitted to the holder 102 in one action when the head 101 and holder 102 are assembled. Cartridge removal is made in return sequence.

For feeding the bristle section 115 by toothpaste the user sets the removable protective cap 103 in on-position (as shown in FIG. 8) and begins to move it in the direction of the toothbrush head 101.

Under the influence of this moving of the removable protective cap 103 in the cavity 113 occurs an excessive air pressure, and air through at least one reach-through hole 122 in the removable closing plug 121 runs into the part 126 of the chamber 118 between plunger 119 and closing plug 121 and moves plunger 119 in a direction of the toothbrush head 101, while in the chamber 118 in front of the plunger 119 air pressure is increased. When external pressure and/or the plunger 119 is influenced to the cartridge 840, toothpaste is forced squeezed out from the cartridge throughout conduit 116 and apertures 117 towards the bristles, such that a portion of the toothpaste is dispensed onto the bristle section 115.

Such design of the toothbrush makes it universal, suitable, as for toothpaste use directly in the chamber, and for use a toothpaste cartridge.

The toothpaste cartridge can be made with a shape, variable under the influence of pressure, and/or can be made from a flexible material, and/or squeezable material. Individual components of the cartridge can be made of metal, nonmetal, and composite materials.

Figure 9:
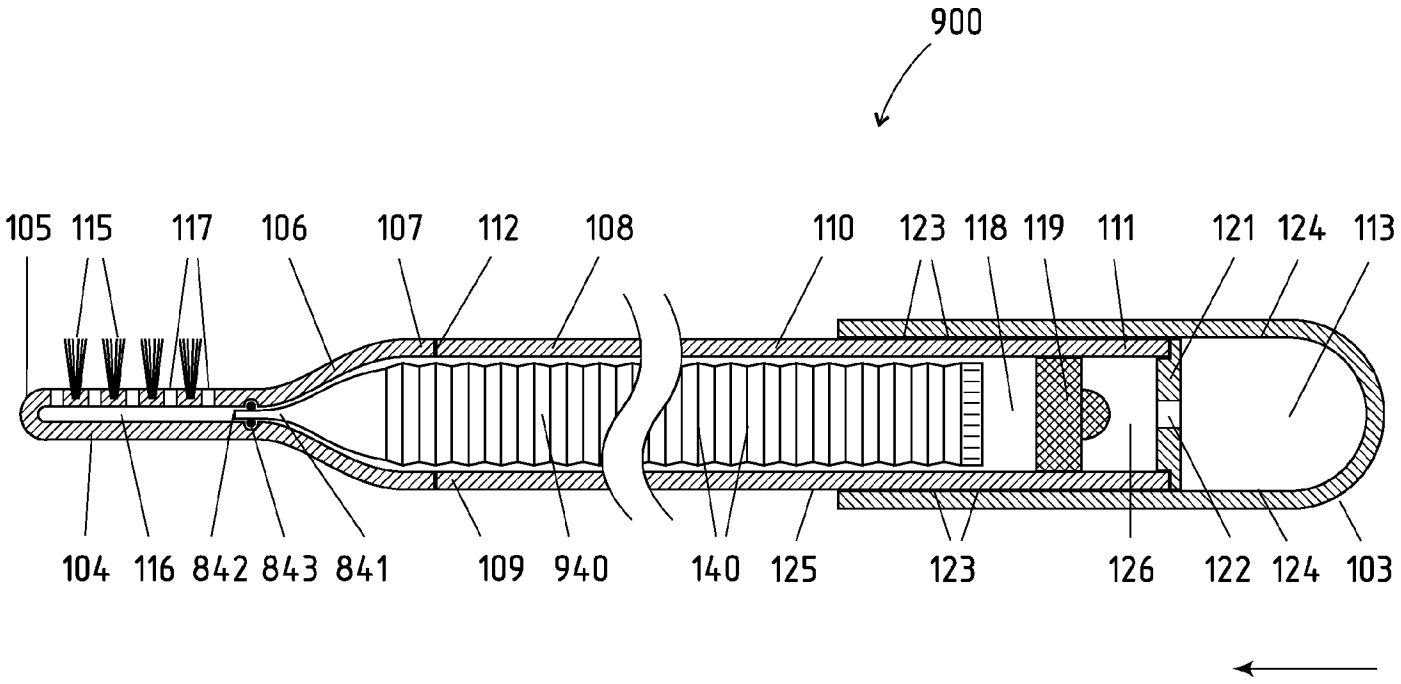
FIG. 9 is a schematic cross sectional view of variety previous embodiment of the present invention wherein a toothpaste cartridge has a special design.

In FIG. 9 is shown a schematic cross sectional view of another embodiment of the present invention in on-position wherein said toothpaste chamber 118 is also adapted to contain a toothpaste cartridge.

A distinctive feature of the present invention is that the toothpaste cartridge 940, imbedded into the chamber 118 of the toothbrush 900, is made with a corrugated sidewall and the corrugations 944 are arranged one after another along the longitudinal axis of the cartridge. How it can be seen from the FIG. 9 said toothpaste cartridge 940 is made with a shape, variable under the influence of pressure.

It also can be made from a flexible and/or squeezable material. Individual components of the cartridge also can be made of metal, nonmetal, and composite materials.

When external pressure and/or the plunger 119 under influence of moving removable protective cap 103 towards the toothbrush head 101 is applied to the cartridge 940, the cartridge is contracting, toothpaste is forced squeezed out from the cartridge throughout conduit 116 and apertures 117 towards the bristles, such that a portion of the toothpaste is dispensed onto the bristle section 115.

Use in invented toothbrush such of the cartridge design improves the toothbrush technical characteristics as allows to dose out more precisely supplied toothpaste to the bristles.

Figures 10A, 10B, 10C, 10D, 10E, 10F, 10G:
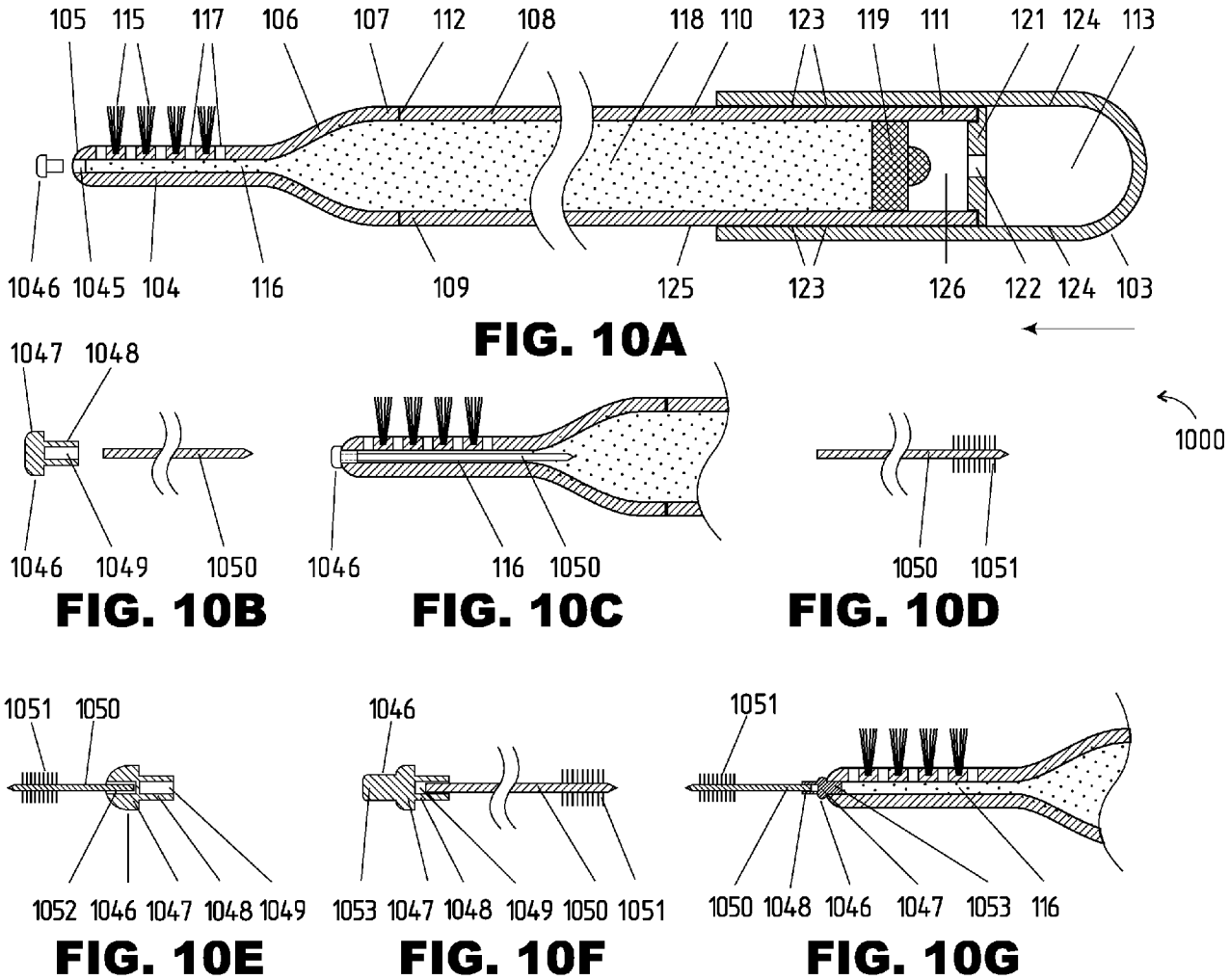
FIG. 10A is a schematic cross sectional view of the next embodiment of the present invention in on-position. This embodiment includes all features of the invention shown in FIGS. 1A-1D, but besides in this embodiment the conduit located inside of the first part of the toothbrush head further is provided with a through-hole disposed on the first free end of the toothbrush head and has a removable top end-cap inserted into said through-hole. Such design additionally improves its ease of cleaning from the remnants of toothpaste before the next recharge of the toothbrush.
FIGS. 10B-10E are schematic cross sectional views of additional details and fragments of embodiment FIG. 10A modifying it and give it a new qualitative features and benefits.
In FIG. 10F schematically shown a removable top end-cap with a closing head and a projection, located on one side of said closing head, adapted to be inserted into said conduit and having a socket for placing into it an end of a removable rod adapted to be let-in said conduit, wherein said removable top end-cap further is provided with an additional projection located on the other side of said closing head, and said additional projection is adapted to be inserted into said conduit.
In FIG. 10G schematically shown the fragment of the toothbrush with a removable top end-cap with a removable rod shown in the FIG. 1 OF wherein said additional projection inserted into said conduit.

FIG. 10A is a schematic cross sectional view of the next embodiment 1000 of the present invention in on-position. This embodiment of the present invention includes all features of the invention shown in FIGS. 1A-1D, but besides in this embodiment the conduit 116 located inside of the first part 104 of the toothbrush head further is provided with a through-hole 1045 disposed in the first free end 105 of the toothbrush head and has a removable top end-cap 1046 inserted into said through-hole 1045.

Such design of the invented toothbrush additional improves the conditions of its cleaning from the remnants of toothpaste before the next recharge toothbrush.

As it shown schematically in the FIG. 10B the conduit's removable top end-cap 1046 can consist of a closing head 1047 and a projection 1048, located on one side of said closing head, adapted to be inserted into said conduit and having a socket 1049 for placing into it an end of a removable rod 1050 adapted to be let-in said conduit 116 (FIG. 10C). The ends of the removable rod can be made blunt and/or sharp.

This embodiment of the present invention allows the use of all the advantages of the previous embodiment of the invention, but for all that the removable rod carries out some useful functions: prevents paste hardening in conduit at long non-use of a brush; serves for clearing the conduit; can serve as a toothpick; can serve as a means for piercing a membrane of a cartridge.

As shown schematically in the fragment (FIG. 10D) of the next modified embodiment of the previous invention, the removable rod 1050 is additionally provided with bristles 1051 for purpose of cleaning hard-to-reach places between the teeth by means of the removable rod.

For convenience of cleaning interdental spaces by means of the removable rod 1050 in the modified embodiments of the previous invention said conduit's removable top end-cap 1046 further is provided either with an additional socket 1052 located on the other side of said closing head 1047 for placing said removable rod 1050 (as shown schematically in the FIG. 10 E), or said removable top end-cap 1046 further is provided with an additional projection 1053 located on the other side of said closing head 1047, i.e. the side opposite the location of the projection 1048 (as shown schematically in the FIG. 10F) and said additional projection 1053 is adapted to be inserted into said conduit 116 (as shown schematically in the FIG. 10G).

Such design of the toothbrush further improves the usability of removable rod 1050 when cleaning interdental spaces.

Figure 11A:
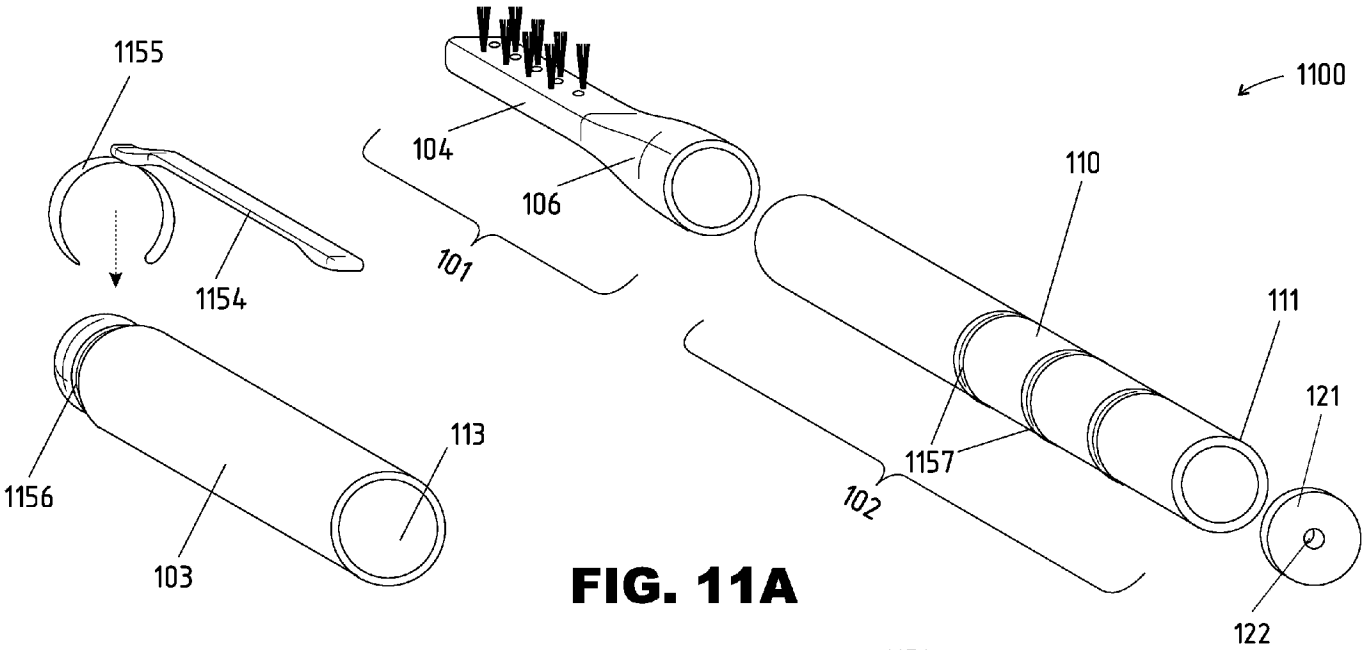
FIGS. 11A and 11B are schematic views another embodiment of the present invention.
Figure 11B:
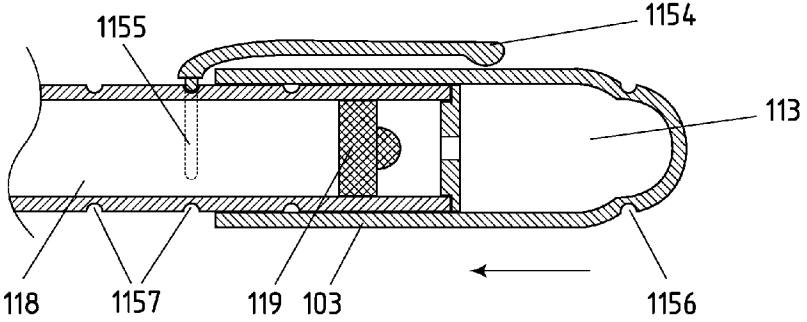

FIGS. 11A and 11B are schematic views another embodiment of the present invention.

FIG. 11A is schematic illustrative perspective view of the present invention in unassembled state. FIG. 11B is a sectional view of fragment of the present invention in on-position. This embodiment of the present invention includes all features of the invention shown in FIGS. 1A-1D, but besides in this embodiment in the refillable toothbrush 1100 the removable protective cap 103 further is supplied with a removable clip 1154, having a spring clamp 1155, and with a spring seat 1156 for placing said spring clamp 1155, besides the second part 110 of toothbrush holder adjacent to its second distal end 111 is provided with at least one spring nest 1157 for placing said spring clamp 1155.

A clip usually realizes the function of fixing a toothbrush in the user's pocket. In this embodiment of the present invention the clip 1154 is made removable and provide with a spring clamp 1155. When the removable clip 1154 is performing its direct function, its spring clamp 1155 is located in the spring seat 1156 on the removable protective cap 103. In on-position (FIG. 11B) the removable clip 1154 is removed from the removable protective cap 103 and is set in one of the spring nest 1157.

In this case, the removable clip 1154 restricts the movement of the removable cup 103 during extrusion of toothpaste from the toothpaste chamber 118 and is used to refine its dosing. Moreover, said removable clip 1154 additionally fixes the position of the removable cup 103 on the second part 110 of the holder.

Use in invented toothbrush such removable protective cap 103 with such removable clip 1154 with said spring clamp 1155 improves the toothbrush technical characteristics as allows to dose out more precisely supplied toothpaste to the bristles.

Figure 12A:
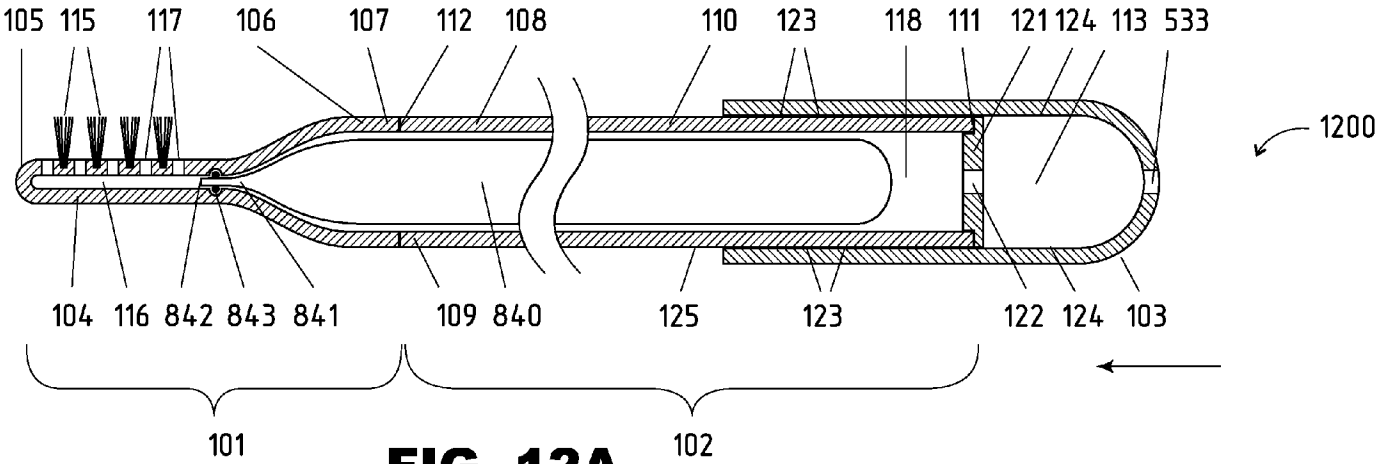
FIGS. 12A and 12B are illustrative schematic views of the alternative variant of the invention wherein toothpaste contained in the cartridge, disposed in the toothpaste chamber.
Figure 12B:
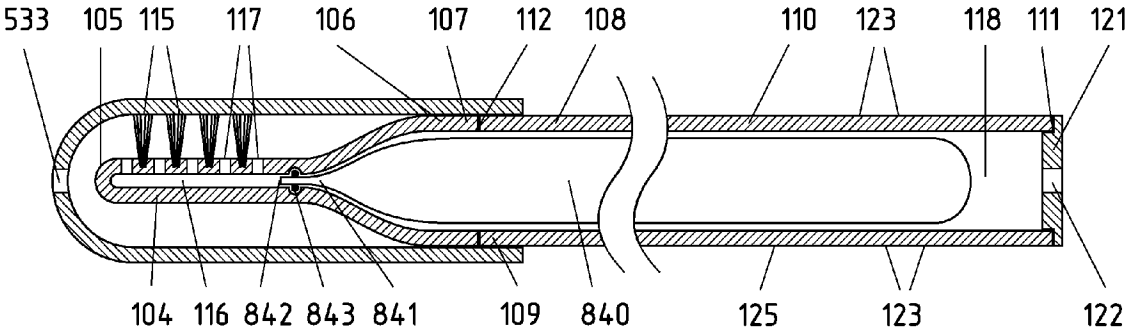

FIGS. 12A and 12B are illustrative schematic views of the alternative variant of the invention.

A refillable toothbrush 1200 comprising:

a toothbrush head 101, a holder 102 and a removable protective cap 103;

the toothbrush head 101 has a first part 104 adjacent to its first free end 105, and a second part 106 adjacent to its second end 107;

the holder 102 has a first part 108 adjacent to its first end 109, coupled to the second end 107 of said toothbrush head 101, and a second part 110 adjacent to its second distal end 111;

numeral 112 denotes a coupling of said holder 102 and said removable toothbrush head 101;

the removable protective cap 103 has a cavity 113 for placing and protecting said toothbrush head 101 and can have a clip 114 (not shown);

the toothbrush head 101 has a bristle section 115, a conduit 116, disposed within said toothbrush head 101, and at least one toothpaste dispensing aperture 117 disposed on said bristle section 115 and being in communication with said conduit;

the holder 102 has a toothpaste chamber 118 disposed within its body, said toothpaste chamber 118 being in communication with said conduit 116, wherein the second distal end 111 of said holder 102 is provided with a closing plug 121 having at least one reach-through hole 122 through which said toothpaste chamber 118 is communicated with the atmosphere;

the removable protective cap 103 is provided with at least one reach-through hole 533 through which the cavity 113 of the protective cap is communicated with the atmosphere and said reach-through hole or holes have a feature to be closed by a user;

the following pairs:

said removable protective cap 103 and the holder's second part 110 adjacent to its second distal end 111 (FIG. 12A), and/or said removable protective cap 103 and the holder's first part 108, adjacent to the holder's first end 109 (FIG. 12B), and/or said removable protective cap 103 and the second part 106 of the toothbrush head 101, adjacent to its second end 107 (FIG. 12B), are configured accordingly to form a kinematic pair having a sliding fit with respect to each other for the purpose of providing a sliding seal between said protective cap 103 and accordingly said second part 110 of said holder 102, said first part 108 of said holder 102, said second part 106 of the toothbrush head 101;

a coupling 112 of said holder and said toothbrush head is made as a permanent joint, while if said closing plug is made removable, or a coupling of said holder and said toothbrush head is made as a detachable joint, while if said closing plug is made non-removable or removable, and said toothpaste chamber 118 is adapted to contain a toothpaste cartridge 840 capable under an external pressure to supply the toothpaste through its outlet 842, and the toothpaste head 101 is adapted to be removably and hermetically connected to said cartridge 840 so that the conduit of said toothbrush head would be in communication with said outlet of said cartridge.

For example, the connection of the toothpaste head 101 with the neck 841 of the cartridge 840 can be realized by means of elastomeric O-ring seal 843, so that the conduit 116 of said toothbrush head 101 would be in communication with said outlet 842 of said cartridge 840.

The purpose of the cartridge is to provide a removable container for storing toothpaste within the toothpaste chamber 118 and to enable the delivery of the toothpaste to the conduit 116 of the toothbrush head 101 and then to the toothpaste dispensing aperture or apertures 117.

These embodiments of the invention are largely similar to the previous embodiment shown in the FIG. 8. The main difference between the inventions is that in the embodiment in FIGS. 12A, 12B is absence of the plunger. Cartridge installation and removing is indicated above (see description to FIG. 8). Difference consists in absence of insertion and extraction the plunger.

FIG. 12A is a schematic sectional view of the present invention wherein the refillable toothbrush shown in on-position. Here the removable protective cap 103 and the holder's second part 110, adjacent to its second distal end 111, are configured to form a kinematic pair having a sliding fit 123 with respect to each other for the purpose of providing a sliding seal between the protective cap 103 and second part 110 of said holder 102. The numeral 124 denotes an inner surface of the protective cap 103 and numeral 125 denotes an outer surface of said second part 110 of said holder 102.

After installing the cartridge and assembling the toothbrush the user sets the removable protective cap 103 in on-position, closes the reach-through hole 533 in the protective cap 103 by a finger and begins to move it in the direction of the toothbrush head 101 for feeding the bristle section 115 by toothpaste (direct arrow shows the direction of motion).

Under the influence of this moving of the removable protective cap 103 in the cavity 113 is occurs an excessive air pressure, and air through at least one reach-through hole 122 in the closing plug 121 runs into the chamber 118 while in the chamber 118 air pressure is increased. When external pressure is influenced to the cartridge 840, toothpaste is forced squeezed out from the cartridge throughout conduit 116 and apertures 117 towards the bristles, such that a portion of the toothpaste is dispensed onto the bristle section 115. The user can adjust the amount of feed toothpaste to the bristle section 115, pumping more or less air into the chamber 118 by means of the protective cap 103. If necessary, the user can perform several cycles of inflation, making the reverse movement of the protective cap 103 with opened reach-through hole 533 and pumping air into the chamber 118 with closed reach-through hole 533.

After toothbrushing the protective cap 103 is installed in stowed position for performing its direct function, namely, protecting bristles.

The present invention solves the problem of creating autonomic, portable, travel and refillable toothbrush, while, thanks to the original design means for supplying paste to the bristles, simplifies the manufactory of such toothbrushes and reduced their costs. Furthermore such design of the invented toothbrush eliminates the plunger, which also simplifies the manufactory of toothbrushes and reduced their costs. Design fully collapsible toothbrush with a reduced number of parts also improves the conditions of toothbrushes cleaning from the remnants of toothpaste before the next recharge toothbrush.

FIG. 12B is a schematic sectional view of the present invention wherein the refillable toothbrush shown in stowed position. In this modification of the present invention the removable protective cap 103 of the refillable toothbrush 1200 and the holder's first part 108, adjacent to the holder's first end 109, are configured to form a kinematic pair having a sliding fit 634 with respect to each other for the purpose of providing a sliding seal between the protective cap 103 and first part 108 of said holder 102 and/or said removable protective cap 103 and the second part 106 of the toothbrush head 101, adjacent to its second end 107, are configured to form a kinematic pair having a sliding fit 635 with respect to each other for the purpose of providing a sliding seal between the protective cap 103 and the second part 106 of the toothbrush head.

This embodiment of the present invention allows the use of all the advantages of the previous embodiment of the invention (FIG. 12A) and additional allows dispensing toothpaste onto the bristle section 115 directly in the stowed position. This expands the technological capabilities of the toothbrush. For this purpose, a user closes the reach-through hole 533 in the removable protective cap 103 by a finger and moves the protective cap in a direction of from the center of the holder 102 to the first free end 105 of the toothbrush head 101 (the straight solid arrow shows the direction of motion). Inasmuch as between the inner surface 124 of the removable protective cap 103 and outer surface of the holder's first part 108 and/or between the inner surface 124 of the removable protective cap 103 and outer surface of the second part 106 of the toothbrush head 101 is formed a sliding fit—accordingly 634 and/or 635, into the cavity 113, when the removable protective cap moving in this direction, forms a vacuum. Due to this, the pressure in the chamber 118 exceeds the pressure in the cavity 113 and fluidly connected with it, dispensing aperture 117 which in turn is connected via conduit 116 with outlet 842 of the cartridge 840. Under the influence of vacuum on one side and the atmospheric air pressure on the other side of the cartridge, toothpaste contained in the cartridge 840 is squeezed out of it and dispensed between the bristles of bristle section 115. Taking off the removable protective cap 103 from the toothbrush head 101 and installation the protective cap in stowed position is made by the user at opened reach-through hole 533.

Figure 13A:
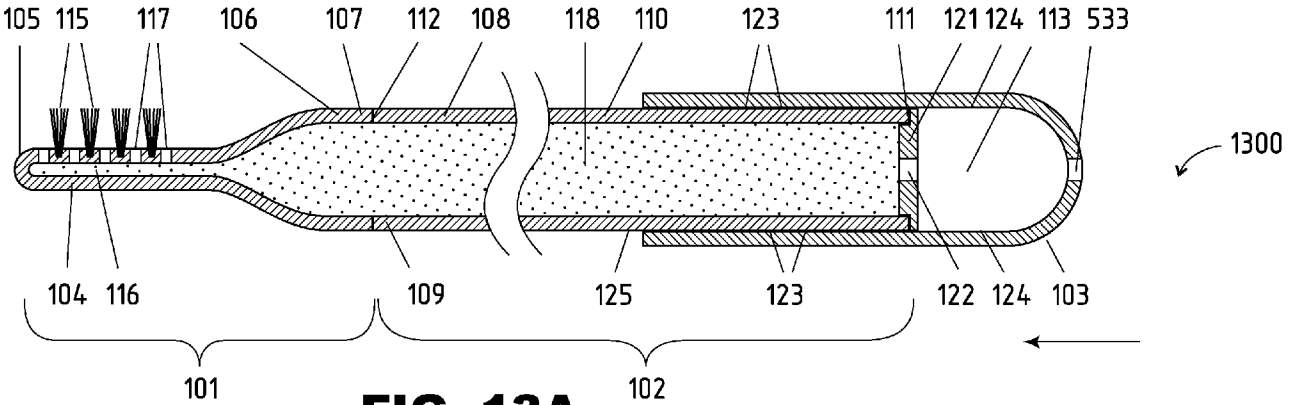
FIGS. 13A and 13B are illustrative schematic views of the other alternative variant of the invention wherein toothpaste contained directly in the toothpaste chamber.
Figure 13B:
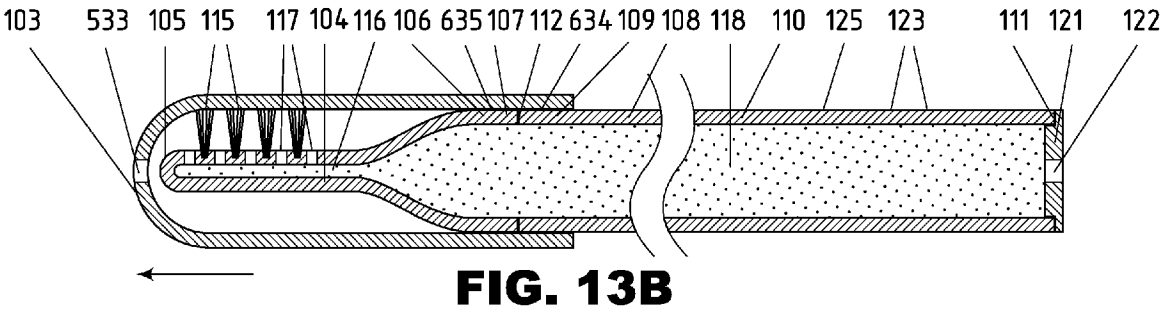

FIGS. 13A and 13B are illustrative schematic views of the alternative variant of the invention. This embodiment of the invention is largely similar to the previous embodiment shown in the FIGS. 12A and 12B. The main difference between the inventions is that in the embodiment in FIGS. 12A and 12B toothpaste contained in the cartridge, disposed in the toothpaste chamber 118, but in the embodiment in FIGS. 13A and 13B toothpaste contained directly in the toothpaste chamber 118. For possibility of such embodiment of the invention special changes are made to designs of a refillable toothbrush.

In FIGS. 13A and 13B a refillable toothbrush 1300 comprising:

a toothbrush head 101, a holder 102 and a removable protective cap 103;

the toothbrush head 101 has a first part 104 adjacent to its first free end 105, and a second part 106 adjacent to its second end 107;

the holder 102 has a first part 108 adjacent to its first end 109, coupled to the second end 107 of said toothbrush head 101, and a second part 110 adjacent to its second distal end 111;

numeral 112 denotes a coupling of said holder 102 and said removable toothbrush head 101;

the removable protective cap 103 has a cavity 113 for placing and protecting said toothbrush head 101 and can have a clip 114 (not shown);

the toothbrush head 101 has a bristle section 115, a conduit 116, disposed within said toothbrush head 101, and at least one toothpaste dispensing aperture 117 disposed on said bristle section 115 and being in communication with said conduit;

the holder 102 has a toothpaste chamber 118 disposed within its body, said toothpaste chamber 118 being in communication with said conduit 116, wherein the second distal end 111 of said holder 102 is provided with a closing plug 121 having at least one reach-through hole 122 through which said toothpaste chamber 118 is communicated with the atmosphere;

the removable protective cap 103 is provided with at least one reach-through hole 533 through which the cavity 113 of the protective cap is communicated with the atmosphere and said reach-through hole or holes have a feature to be closed by a user; the following pairs:

said removable protective cap 103 and the holder's second part 110 adjacent to its second distal end 111 (FIG. 13A), and/or said removable protective cap 103 and the holder's first part 108, adjacent to the holder's first end 109 (FIG. 13B), and/or said removable protective cap 103 and the second part 106 of the toothbrush head 101, adjacent to its second end 107 (FIG. 13B), are configured accordingly to form a kinematic pair having a sliding fit with respect to each other for the purpose of providing a sliding seal between said protective cap 103 and accordingly said second part 110 of said holder 102, said first part 108 of said holder 102, said second part 106 of the toothbrush head 101;

a coupling 112 of said holder and said toothbrush head is made as a permanent joint, while if said closing plug is made removable, or a coupling of said holder and said toothbrush head is made as a detachable joint, while if said closing plug is made non-removable or removable, and a passage of said at least one reach-through hole 122 of said closing plug 121 is sized so as to permit air, but not toothpaste, to flow easily therethrough, or the second distal end 111 of the holder 102 and/or the closing plug 121 is additionally equipped with a removable back cover, or said closing plug 121 is additionally equipped with a removable bottom end-cap 1360.

Figures 13C, 13D, 13E:
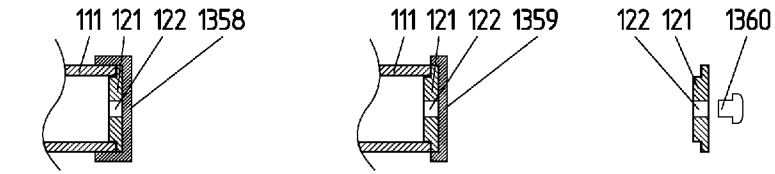
FIGS. 13C-13F are schematic cross sectional views of additional details and fragments of the embodiment is shown in FIGS. 13A and 13B, modifying it and give it a new qualitative features and benefits.

In FIG. 13C is shown a fragment of the second distal end 111 of the holder 102 and the closing plug 121 with put on they a removable back cover 1358.

In FIG. 13D is shown a fragment of the second distal end 111 of the holder 102 and the closing plug 121 with on it another kind of a removable back cover 1359 on it.

In FIG. 13E is shown a removable bottom end-cap 1360 inserted into reach-through hole 122 in removable closing plug 121.

The size of the passage or passages accordingly of the reach-through hole or holes of the closing plug 121 depend on set characteristics of the paste and toothbrush and their relations: the viscosity and fluidity of the paste, its temperature, its surface tension, the material of the closing plug and toothpaste chamber, the design features of the refillable toothbrush etc. For example, for pastes with high viscosity and low fluidity, poor wettability the material of the closing plug the transverse dimensions of the holes can be larger, and vice versa. However, for most pastes transverse dimensions of the reach-through hole or holes in the protective cap can be chosen as 1 mm or less. The reach-through hole or holes can have different configurations (not shown).

FIG. 13A is a schematic sectional view of the present invention wherein the refillable toothbrush shown in on-position. Here the removable protective cap 103 and the holder's second part 110, adjacent to its second distal end 111, are configured to form a kinematic pair having a sliding fit 123 with respect to each other for the purpose of providing a sliding seal between the protective cap 103 and second part 110 of said holder 102. The numeral 124 denotes an inner surface of the protective cap 103 and numeral 125 denotes an outer surface of said second part 110 of said holder 102.

Filling of the chamber 118 by toothpaste can be carried out either at a removed toothbrush head 101, or at a removed closing plug 121 by means of squeezing toothpaste from a tube directly into the toothpaste chamber 118. After filling toothpaste the toothpaste chamber 118 must be closed.

For feeding the bristle section 115 by toothpaste the user sets the removable protective cap 103 in on-position, closes the reach-through hole 533 in the protective cap 103 by a finger and begins to move it in the direction of the toothbrush head 101 (the straight solid arrow shows the direction of motion).

Under the influence of this moving of the removable protective cap 103 in the cavity 113 occurs an excessive air pressure, and air through at least one reach-through hole 122 in the closing plug 121 runs into the chamber 118 while in the chamber 118 air pressure is increased. When external pressure is influenced to toothpaste, it is forcibly squeezed out from the chamber 118 throughout conduit 116 and apertures 117 towards the bristles, such that a portion of the toothpaste is dispensed onto the bristle section 115.

The user can adjust the amount of feed toothpaste to the bristle section 115, pumping more or less air into the chamber 118 by means of the protective cap 103. If necessary, the user can perform several cycles of inflation, making the reverse movement of the protective cap 103 with opened reach-through hole 533 and pumping air into the chamber 118 with closed reach-through hole 533.

After toothbrushing, the protective cap 103 is installed in stowed position for performing its direct function, namely, protecting the bristles.

The present invention, as the previous embodiment of the invention, solves the problem of creating an autonomic, portable, travel and refillable toothbrush, while, thanks to the original design means for supplying paste to the bristles, simplifies the manufactory of such toothbrushes and reduced their costs.

Furthermore such design of the invented toothbrush eliminates the plunger, which also simplifies the manufactory of toothbrushes and reduced their costs. Design fully collapsible toothbrush with a reduced number of parts also improves the conditions of toothbrushes cleaning from the remnants of toothpaste before the next recharge toothbrush.

FIG. 13B is a schematic sectional view of the present invention wherein the refillable toothbrush shown in stowed position. In this modification of the present invention the removable protective cap 103 of the refillable toothbrush 1300 and the holder's first part 108, adjacent to the holder's first end 109, further are configured to form a kinematic pair having a sliding fit 634 with respect to each other for the purpose of providing a sliding seal between the protective cap 103 and first part 108 of said holder 102 and/or said removable protective cap 103 and the second part 106 of the toothbrush head 101, adjacent to its second end 107, further are configured to form a kinematic pair having a sliding fit 635 with respect to each other for the purpose of providing a sliding seal between the protective cap 103 and the second part 106 of the toothbrush head.

This embodiment of the present invention allows the use of all the advantages of the previous embodiment of the invention (FIG. 13A) and additional allows dispensing toothpaste onto the bristle section 115 directly in the stowed position. This expands the technological capabilities of the toothbrush.

For this purpose, a user closes the reach-through hole 533 in the removable protective cap 103 by a finger and moves the protective cap in a direction of from the center of the holder 102 to the first free end 105 of the toothbrush head 101 (arrow shows the direction of motion).

Inasmuch as between the inner surface 124 of the removable protective cap 103 and outer surface of the holder's first part 108 and/or between the inner surface 124 of the removable protective cap 103 and outer surface of the second part 106 of the toothbrush head 101 is formed a sliding fit —accordingly 634 and/or 635, into the cavity 113, when the removable protective cap moving in this direction, forms a vacuum.

Due to it the pressure into the chamber 118 exceeds the pressure in the cavity 113 and fluidly connected with it the dispensing aperture 117 which is in turn connected via conduit 116 with the chamber 118. Under the influence of vacuum on one side and the atmospheric air pressure on the other side toothpaste contained in the toothpaste chamber 118 is squeezed out of it through conduit 116 and the dispensing aperture 117 and dispensed between the bristles of bristle section 115.

Taking off the removable protective cap 103 from the toothbrush head 101 and installation the protective cap in stowed position is made by the user at opened reach-through hole 533.

Figure 13F:
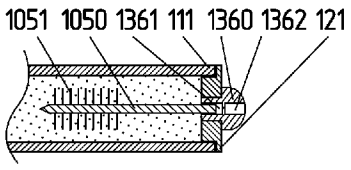

In FIG. 13F is shown a fragment of the second distal end 111 of the holder 102 and the closing plug 121 with a removable bottom end-cap 1360 inserted into its reach-through hole 122. The removable bottom end-cap further can be equipped with a removable rod 1050, having an ability to be let-in said reach-through hole of said closing plug 121, said removable rod 1050 having at least one end is made blunt or sharp, and having an ability to be fastened to one or both sides of said removable bottom end-cap 1360. For this purpose the removable bottom end-cap 1360 can have, for example, a socket 1361 from the one side and an additional socket 1362 from the other side.

The removable rod 1050 further can be provided with bristles 1051 for purpose to clean hard-to-reach places between the teeth. This additional removable rod is spare and can be used for the same purpose, as it explained above (see description to FIGS. 10B, 10D and 10E). Supplying the above embodiments of the present invention with said removable rod extends the technological capabilities of refillable toothbrushes and their usability.

To expand the technological capabilities of the embodiment of the present invention, represented in FIGS. 13A and 13B, the toothpaste chamber of said refillable toothbrush further is adapted to contain a toothpaste cartridge, capable under an external pressure to supply the toothpaste through its outlet, and the toothpaste head is adapted to be removably connected to said cartridge so that the conduit of said toothbrush head would be in communication with said outlet of said cartridge.

Schematic representation of the embodiment of the present invention and its use are similar to the schematic view of the embodiment shown in the FIGS. 12A and 12B and work with said embodiment. Therefore, pictures of this embodiment and description of its work are omitted. Such design of the toothbrush does it universal, suitable, as for toothpaste use directly in the chamber, and for use a toothpaste cartridge.

Figure 14:
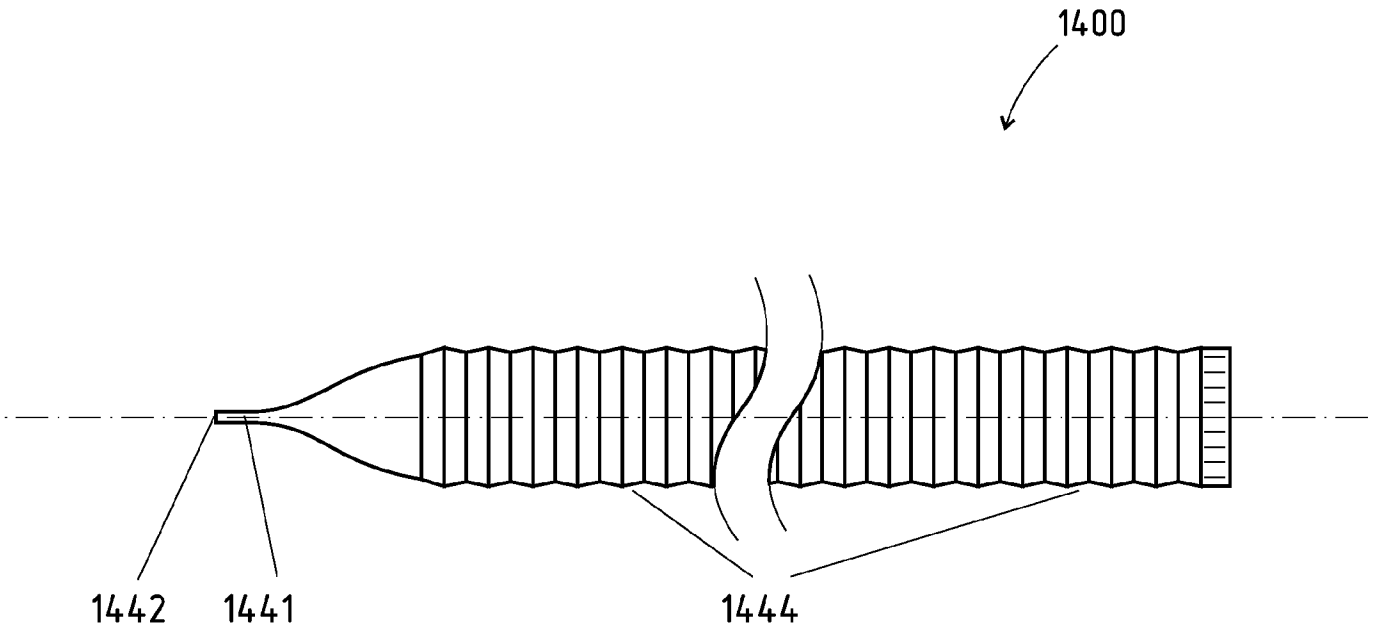
In FIG. 14 is shown a schematic cross sectional view of a toothpaste cartridge, which is another object of the present invention.

In FIG. 14 is shown a schematic cross sectional view of a toothpaste cartridge, which is another object of the present invention. A toothpaste cartridge 1400 capable under an external pressure to supply toothpaste through its outlet 1442, wherein a sidewall of said toothpaste cartridge is made corrugated and wherein the corrugations 1444 are arranged one after another along the longitudinal axis of the cartridge 1400. Here numeral 1441 denotes a neck of toothpaste cartridge 1400 with a corrugated sidewall. The outlet 1442 of the toothpaste cartridge before using is closed, for example, by means of membrane (not shown).

How it can be seen from the FIG. 14 said toothpaste cartridge 1400 is made with a shape, variable under the influence of pressure. It can be made from a flexible and/or squeezable material. Individual components of the cartridge can be made of metal, nonmetal, and composite materials.

Use in toothbrushes such of the cartridge design improves the toothbrush technical characteristics as allows to dose out more precisely supplied toothpaste to the bristles.

COMPONENT LIST

100—refillable toothbrush
101—toothbrush head
102—holder
103—removable protective cap
104—first part of the toothbrush head
105—first free end of the toothbrush head
106—second part of the toothbrush head
107—second end of the toothbrush head
108—first part of the holder
109—first end of the holder
110—second part of the holder
111—second distal end of the holder
112—coupling of the holder 102 and the toothbrush head 101
113—cavity of the removable protective cap 103
114—clip
115—bristle section
116—conduit
117—at least one toothpaste dispensing aperture
118—toothpaste chamber
119—plunger
120—plunger tang
121—closing plug (non-removable or removable)
122—at least one reach-through hole in removable closing plug 121
123—sliding fit between the removable protective cap 103 and the holder's second part 110
124—inner surface of the protective cap 103
125—outer surface of the second part 110 of the holder 102
126—the part of the chamber 118 between plunger 119 and closing plug 121
200—embodiment 200 of the present invention
227—sealing ring inserted into a ring groove 228 on the protective cap inner surface 124
228—ring groove on the protective cap inner surface 124
300—refillable toothbrush
329—sealing ring
330—ring groove on the second distal end 111 of the holder outer surface 125
400—refillable toothbrush
431—check valve in protective cap
432—reach-through hole in protective cap
500—refillable toothbrush
533—reach-through hole in protective cap
600—refillable toothbrush
634—sliding fit between the removable protective cap 103 and the holder's first part 108
635—sliding fit between the removable protective cap 103 and the second part 106 of the toothbrush head
700—refillable toothbrush
736—sealing ring inserted into a ring groove 737 on the outer surface of the holder's first part 108
737—ring groove
738—sealing ring inserted into a ring groove 739 on the outer surface of the second part 106 of the toothbrush head 101
739—ring groove
800—alternate embodiment of the present invention

840—toothpaste cartridge
841—neck of the cartridge
842—outlet
843—O-ring seal
900—another embodiment of the toothbrush
940—toothpaste cartridge with a corrugated sidewall
944—corrugations
1000—a schematic cross sectional view of the alternate embodiment of the present invention
1045—through-hole disposed on the first free end 105 of the toothbrush head
1046—removable top end-cap
1047—closing head
1048—projection
1049—socket
1050—a removable rod having an ability to be let-in the conduit 116
1051—bristles of the removable rod
1052—additional socket located on the other side of said closing head 1047
1053—additional projection of the removable top end-cap 1046
1154—removable clip having a spring clamp
1155—spring clamp
1156—spring seat on the removable protective cap 103 for placing the spring clamp 1150
1157—spring nest on the second part 110 of toothbrush holder 102 for placing the spring clamp
1200—refillable toothbrush
1300—refillable toothbrush
1358—removable back cover
1359—another kind of a removable back cover
1360—removable bottom end-cap
1361—socket of the removable bottom end-cap 1360
1362—additional socket of the removable bottom end-cap 1360
1400—toothpaste cartridge with a corrugated sidewall
1441—neck of the cartridge 1400
1442—outlet of the cartridge 1400
1444—corrugations of the cartridge 1400

The invention claimed is:

1. A refillable toothbrush comprising:

a toothbrush head having a first part adjacent to its first free end, and a second part adjacent to its second end;

a holder having a first part adjacent to its first end, coupled to the second end of said toothbrush head, and a second part adjacent to its second distal end;

a removable protective cap having a cavity for placing and protecting said toothbrush head;

said toothbrush head having a bristle section, a conduit, disposed within said toothbrush head, and at least one toothpaste dispensing aperture disposed on said bristle section and being in communication with said conduit;

said holder having a toothpaste chamber disposed within its body;

said toothpaste chamber being in communication with said conduit, and into the toothpaste chamber is placed a plunger, wherein the second distal end of said holder is provided with a closing plug having at least one reach-through hole through which said toothpaste chamber is communicated with the atmosphere;

the removable protective cap and the holder's second part, adjacent to its second distal end, are configured to form a kinematic pair having a sliding fit with respect to each other for the purpose of providing a sliding seal between the protective cap and second part of said holder;

a coupling of said holder and said toothbrush head is made as a permanent joint, while if said closing plug is made removable, or a coupling of said holder and said toothbrush head is made as a detachable joint, while if said closing plug is made non-removable or removable.

2. The refillable toothbrush of claim 1, wherein the removable protective cap further is provided with at least one sealing ring inserted into a ring groove on its inner surface, or the second distal end of said holder is provided with at least one sealing ring inserted into a ring groove on its outer surface.

3. The refillable toothbrush of claim 1, wherein said removable protective cap further is provided with a check valve that opens when said removable protective cap is displaced from the center of said holder towards its second distal end and closes when said removable protective cap is displaced towards to the center.

4. The refillable toothbrush of claim 1, wherein said removable protective cap further is provided with at least one reach-through hole through which the cavity of the protective cap is communicated with the atmosphere and said reach-through hole or holes have a feature to be closed by a user.

5. The refillable toothbrush of claim 4, wherein the removable protective cap and the holder's first part, adjacent to the holder's first end, further are configured to form a kinematic pair having a sliding fit with respect to each other for the purpose of providing a sliding seal between the protective cap and first part of said holder and/or wherein the removable protective cap and the second part of the toothbrush head, adjacent to its second end, further are configured to form a kinematic pair having a sliding fit with respect to each other for the purpose of providing a sliding seal between the protective cap and the second part of the toothbrush head.

6. The refillable toothbrush of claim 5, wherein said removable protective cap further is provided with at least one sealing ring inserted into a ring groove on its inner surface, or wherein accordingly said holder's second part, and/or said holder's first part and/or said second part of the toothbrush head is provided with at least one sealing ring inserted into a ring groove on their outer surface.

7. The refillable toothbrush of claim 1, wherein said toothpaste chamber further is adapted to contain a toothpaste cartridge which under an external pressure is capable of supplying toothpaste through its outlet, and the toothpaste head is adapted to be removably and hermetically connected to said cartridge so that the conduit of said toothbrush head would be in communication with said outlet of said cartridge.

8. The refillable toothbrush of claim 7, wherein said toothpaste cartridge further is made with a shape, variable under the influence of pressure, and/or is made from a flexible material, and/or squeezable material.

9. The refillable toothbrush of claim 7, wherein a sidewall of said toothpaste cartridge further is made corrugated and wherein the corrugations are arranged one after another along the longitudinal axis of the cartridge.

10. The refillable toothbrush of claim 1, wherein said conduit of the toothbrush head further is provided with a through-hole disposed in the first free end of the toothbrush head and has a removable top end-cap inserted into said through-hole.

11. The refillable toothbrush of claim 10, wherein said conduit's removable top end-cap is consisted of a closing head and a projection, located on one side of said closing head, adapted to be inserted into said conduit and having a socket for placing into it an end of a removable rod adapted to be let-in in said conduit.

12. The refillable toothbrush of claim 11, wherein said removable rod further is provided with bristles for purpose to clean hard-to-reach places between the teeth.

13. The refillable toothbrush of claim 11, wherein said conduit's removable top end-cap further is provided either with an additional socket located on the other side of said closing head for placing said removable rod, or said removable top end-cap further is provided with an additional projection located on the other side of said closing head and said additional projection is adapted to be inserted into said conduit.

14. The refillable toothbrush of claim 1, wherein said removable protective cap further is supplied with a removable clip, having a spring clamp, and with a spring seat for placing said spring clamp, besides the second part of said holder adjacent to its second distal end is provided with at least one spring nest for placing said spring clamp.

15. A refillable toothbrush comprising:

a toothbrush head having a first part adjacent to its first free end, and a second part adjacent to its second end;

a holder having a first part adjacent to its first end, coupled to the second end of said toothbrush head, and a second part adjacent to its second distal end;

a removable protective cap having a cavity for placing and protecting said toothbrush head;

said toothbrush head having a bristle section, a conduit, disposed within said toothbrush head, and at least one toothpaste dispensing aperture disposed on said bristle section and being in communication with said conduit;

said holder having a toothpaste chamber disposed within its body;

said toothpaste chamber being in communication with said conduit, wherein the second distal end of said holder is provided with a closing plug having at least one reach-through hole through which said toothpaste chamber is communicated with the atmosphere;

the removable protective cap is provided with at least one reach-through hole through which the cavity of the protective cap is communicated with the atmosphere and said reach-through hole or holes have a feature to be closed by a user;

the following pairs:

said removable protective cap and the holder's second part adjacent to its second distal end, and/or said removable protective cap and the holder's first part, adjacent to the holder's first end, and/or said removable protective cap and the second part of the toothbrush head, adjacent to its second end, are configured accordingly to form a kinematic pair having a sliding fit with respect to each other for the purpose of providing a sliding seal between said protective cap and accordingly said second part of said holder, said first part of said holder, said second part of the toothbrush head;

a coupling of said holder and said toothbrush head is made as a permanent joint, while if said closing plug is made removable, or a coupling of said holder and said toothbrush head is made as a detachable joint, while if said closing plug is made non-removable or removable, and said toothpaste chamber is adapted to contain a toothpaste cartridge capable under an external pressure to supply the toothpaste through its outlet, and the toothpaste head is adapted to be removably and hermetically connected to said cartridge so that the conduit of said toothbrush head would be in communication with said outlet of said cartridge.

16. A refillable toothbrush comprising:

a toothbrush head having a first part adjacent to its first free end, and a second part adjacent to its second end;

a holder having a first part adjacent to its first end, coupled to the second end of said toothbrush head, and a second part adjacent to its second distal end;

a removable protective cap having a cavity for placing and protecting said toothbrush head;

said toothbrush head having a bristle section, a conduit, disposed within said toothbrush head, and at least one toothpaste dispensing aperture disposed on said bristle section and being in communication with said conduit;

said holder having a toothpaste chamber disposed within its body;

said toothpaste chamber being in communication with said conduit, wherein the second distal end of said holder is provided with a closing plug having at least one reach-through hole through which said toothpaste chamber is communicated with the atmosphere;

the removable protective cap is provided with at least one reach-through hole through which the cavity of the protective cap is communicated with the atmosphere and said reach-through hole or holes have a feature to be closed by a user;

the following pairs:

said removable protective cap and the holder's second part adjacent to its second distal end, and/or said removable protective cap and the holder's first part, adjacent to the holder's first end, and/or said removable protective cap and the second part of the toothbrush head, adjacent to its second end, are configured accordingly to form a kinematic pair having a sliding fit with respect to each other for the purpose of providing a sliding seal between said protective cap and accordingly said second part of said holder, said first part of said holder, said second part of the toothbrush head;

a coupling of said holder and said toothbrush head is made as a permanent joint, while if said closing plug is made removable, or a coupling of said holder and said toothbrush head is made as a detachable joint, while if said closing plug is made non-removable or removable, and a passage of said at least one reach-through hole of said closing plug is sized so as to permit air, but not toothpaste, to flow easily therethrough, or the second distal end of the holder or the closing plug is additionally equipped with a removable back cover, or said closing plug is additionally equipped with a removable bottom end-cap.

17. The refillable toothbrush of claim 16, wherein said removable bottom end-cap further is equipped with a removable rod, adapted to be let in said reach-through hole in said closing plug and having at least one end is made blunt or sharp, and said removable bottom end-cap is adapted to fasten said removable rod on inner or on inner and outer sides of said removable bottom end-cap.

18. The refillable toothbrush of claim 17, wherein said removable rod further is provided with bristles for the purpose of cleaning hard-to-reach places between the teeth.

19. The refillable toothbrush of claim 16, wherein said toothpaste chamber further is adapted to contain a toothpaste cartridge, capable under an external pressure to supply the toothpaste through its outlet, and the toothpaste head is adapted to be removably connected to said cartridge so that the conduit of said toothbrush head would be in communication with said outlet of said cartridge.

* * * * *